US012560163B2

(12) United States Patent
Kay et al.

(10) Patent No.: US 12,560,163 B2
(45) Date of Patent: Feb. 24, 2026

(54) CRADLE PLATE FOR HIGH PRESSURE RECIPROCATING PUMPS

(71) Applicant: GD Energy Products, LLC, Tulsa, OK (US)

(72) Inventors: Konner Casey Kay, Broken Arrow, OK (US); Adam Bradley Avey, Tulsa, OK (US); Kale Patrick Woosley, Tulsa, OK (US)

(73) Assignee: GD ENERGY PRODUCTS, LLC, Tulsa, OK (US)

( * ) Notice: Subject to any disclaimer, the term of this patent is extended or adjusted under 35 U.S.C. 154(b) by 0 days.

(21) Appl. No.: 18/829,514

(22) Filed: Sep. 10, 2024

(65) Prior Publication Data

US 2024/0426293 A1 Dec. 26, 2024

Related U.S. Application Data

(63) Continuation of application No. 17/972,749, filed on Oct. 25, 2022, now Pat. No. 12,129,847.

(51) Int. Cl.

| | |
|---|---|
| ***F04B 53/00*** | (2006.01) |
| ***F04B 19/22*** | (2006.01) |
| ***F04B 53/16*** | (2006.01) |
| ***F04B 53/22*** | (2006.01) |

(52) U.S. Cl.

CPC ..... *F04B 53/00* (2013.01); *F04B 19/22* (2013.01); *F04B 53/16* (2013.01); *F04B 53/164* (2013.01); *F04B 53/22* (2013.01)

(58) Field of Classification Search

CPC ..... F04B 19/22; F04B 53/00; F04B 53/16; F04B 53/164; F04B 53/22

See application file for complete search history.

(56) References Cited

U.S. PATENT DOCUMENTS

| | | | |
|---|---|---|---|
| 3,373,695 | A | 3/1968 | Yohpe |
| 4,277,229 | A | 7/1981 | Pacht |
| 4,878,815 | A | 11/1989 | Stachowiak |
| 5,253,987 | A | 10/1993 | Harrison |
| 5,302,087 | A | 4/1994 | Pacht |
| 6,241,492 | B1 | 6/2001 | Pacht |
| 6,419,459 | B1 | 7/2002 | Sibbing |
| 8,528,462 | B2 | 9/2013 | Pacht |
| 9,188,123 | B2 | 11/2015 | Hubenschmidt et al. |
| 9,284,953 | B2 | 3/2016 | Blume |
| 9,976,544 | B2 | 5/2018 | Morreale |
| 10,184,470 | B2 | 1/2019 | Barnett, Jr. |

(Continued)

FOREIGN PATENT DOCUMENTS

| | | | |
|---|---|---|---|
| WO | 2021195572 | A1 | 9/2021 |
| WO | 2021211767 | A1 | 10/2021 |

*Primary Examiner* — Matthew Wiblin

(74) *Attorney, Agent, or Firm* — Edell, Shapiro & Finnan, LLC

(57) ABSTRACT

A cradle plate for high pressure reciprocating pumps is installable within a cradle disposed between a power end of a high pressure reciprocating pump and a fluid end of the high pressure reciprocating pump. The cradle plate has a main body that extends from a front surface to a back surface and a first set of openings that extend through the main body. The first set of openings are configured to receive a set of elongate couplers that position the cradle plate within the cradle in a position that secures a fluid end component against a casing of the fluid end, against a seal of the fluid end, or against both the casing and the seal.

20 Claims, 15 Drawing Sheets

(56) References Cited

U.S. PATENT DOCUMENTS

| | | | |
|---|---|---|---|
| 10,247,184 | B2 | 4/2019 | Chunn et al. |
| 10,288,178 | B2 | 5/2019 | Nowell et al. |
| 10,591,070 | B2 | 3/2020 | Nowell et al. |
| 10,648,490 | B2 | 5/2020 | Foster et al. |
| 10,670,013 | B2 | 6/2020 | Foster et al. |
| 10,724,635 | B1 | 7/2020 | Chady |
| 10,760,567 | B2 | 9/2020 | Salih et al. |
| 10,781,803 | B2 | 9/2020 | Kumar et al. |
| 10,895,325 | B2 | 1/2021 | Nowell et al. |
| 10,907,738 | B2 | 2/2021 | Nowell et al. |
| 10,941,765 | B2 | 3/2021 | Nowell et al. |
| 10,941,866 | B2 | 3/2021 | Nowell et al. |
| 10,962,001 | B2 | 3/2021 | Nowell et al. |
| 10,989,188 | B2 | 4/2021 | Surjaatmadja et al. |
| D928,917 | S | 8/2021 | Nowell et al. |
| 11,078,903 | B2 | 8/2021 | Nowell et al. |
| 11,105,322 | B2 | 8/2021 | Marica |
| 11,131,295 | B2 | 9/2021 | Mullins et al. |
| 11,143,315 | B2 | 10/2021 | Nowell et al. |
| 11,162,479 | B2 | 11/2021 | Thomas et al. |
| 11,168,676 | B2 | 11/2021 | Lesko |
| 11,208,996 | B2 | 12/2021 | Foster et al. |
| 11,208,997 | B2 | 12/2021 | Chady et al. |
| 11,268,507 | B2 | 3/2022 | Chady et al. |
| 11,293,432 | B2 | 4/2022 | Cordes et al. |
| 11,300,111 | B2 | 4/2022 | Thomas et al. |
| 11,346,339 | B2 | 5/2022 | Nowell et al. |
| 11,359,615 | B2 | 6/2022 | Thomas et al. |
| 11,391,374 | B1 | 7/2022 | Ellisor et al. |
| 11,421,679 | B1 | 8/2022 | Mullins et al. |
| 11,434,901 | B2 | 9/2022 | Nowell et al. |
| 11,454,321 | B2 | 9/2022 | Mullins et al. |
| 2018/0266573 | A1 | 9/2018 | Nowell et al. |
| 2019/0120389 | A1 | 4/2019 | Foster et al. |
| 2019/0178243 | A1 | 6/2019 | Nowell et al. |
| 2019/0226589 | A1 | 7/2019 | Nowell et al. |
| 2019/0360483 | A1 | 11/2019 | Nowell et al. |
| 2019/0368619 | A1 | 12/2019 | Barnett et al. |
| 2020/0232450 | A9 | 7/2020 | Nowell et al. |
| 2020/0284253 | A1 | 9/2020 | Foster et al. |
| 2020/0291928 | A1 | 9/2020 | Mullins et al. |
| 2020/0386221 | A1 | 12/2020 | Pham et al. |
| 2021/0095650 | A1 | 4/2021 | Nowell et al. |
| 2021/0102630 | A1 | 4/2021 | Nowell et al. |
| 2021/0108734 | A1 | 4/2021 | Nowell et al. |
| 2021/0148208 | A1 | 5/2021 | Thomas et al. |
| 2021/0148346 | A1 | 5/2021 | Foster et al. |
| 2021/0190067 | A1 | 6/2021 | Nowell et al. |
| 2021/0215154 | A1 | 7/2021 | Nowell et al. |
| 2021/0270263 | A1 | 9/2021 | Stephens et al. |
| 2021/0340978 | A1 | 11/2021 | Graham et al. |
| 2021/0341079 | A1 | 11/2021 | Thomas et al. |
| 2021/0348690 | A1 | 11/2021 | Nowell et al. |
| 2021/0404464 | A1 | 12/2021 | Patoskie |
| 2021/0404561 | A1 | 12/2021 | Nowell et al. |
| 2022/0018385 | A1 | 1/2022 | Marica |
| 2022/0099073 | A1 | 3/2022 | Thomas et al. |
| 2022/0106951 | A1 | 4/2022 | Foster et al. |
| 2022/0163033 | A1 | 5/2022 | Myers et al. |
| 2022/0163034 | A1 | 5/2022 | Foster et al. |
| 2022/0170580 | A1 | 6/2022 | Stratulate et al. |
| 2022/0186718 | A1 | 6/2022 | Peer |
| 2022/0195853 | A1 | 6/2022 | Nowell et al. |
| 2022/0282719 | A1 | 9/2022 | Barnhouse |
| 2022/0307486 | A1 | 9/2022 | Thomas et al. |

CRADLE PLATE FOR HIGH PRESSURE RECIPROCATING PUMPS

CROSS-REFERENCE

This application claims priority to and the benefit of U.S. patent application Ser. No. 17/972,749, entitled "CRADLE PLATE FOR HIGH PRESSURE RECIPROCATING PUMPS," filed Oct. 25, 2022, which is hereby incorporated in its entirety for all purposes.

FIELD OF INVENTION

The present invention relates to the field of high pressure reciprocating pumps and, in particular, to securing a fluid end component to a fluid end of a high pressure reciprocating pump.

BACKGROUND

High pressure reciprocating pumps are often used to deliver high pressure fluids during earth drilling operations. Generally, a reciprocating pump includes a power end and a fluid end. The power end can generate forces sufficient to cause the fluid end to deliver high pressure fluids to earth drilling operations. In the fluid end, one or more seals typically prevent, or at least discourage, leakage. For example, in a reciprocating pump intended for fracking operations (i.e., a frack pump), packing seals may provide a seal around a plunger to prevent fluid from leaking between the plunger and a bore within which the plunger is reciprocating. For the seal to be effective it must be retained in place in the fluid end.

SUMMARY

The present application relates to techniques for securing one or more fluid end components, such as a stuffing box and/or gland nut, against a fluid end of a high pressure reciprocating pump and/or against a seal of the fluid end. The techniques may be embodied as a cradle plate (for, simplicity, sometimes referred to simply as "plate") that is provided independent of any other elements, a power end including a cradle plate, a fluid end including a cradle plate, and/or a reciprocating pump including a cradle plate. Additionally, the techniques may be embodied as one or more methods for securing one or more fluid end components to a fluid end of a high pressure reciprocating pump.

More specifically, in accordance with at least one embodiment, the present application is directed to a reciprocating pump including a power end, a fluid end, a set of elongate couplers, and a cradle plate. The power end is configured to generate pumping power and the fluid end is configured to deliver a fluid from an inlet bore to an outlet bore as the power end generates the pumping power. The set of elongate couplers couple the power end to the fluid end in a spaced relationship to define a cradle between the power end and the fluid end. The cradle plate (or "plate") includes a first set of openings configured to receive couplers of the set of elongate couplers. The couplers position the cradle plate within the cradle in a position that secures a fluid end component against a casing of the fluid end, against a seal of the fluid end, or against both the casing and the seal. Advantageously, this may transfer a load experienced by the fluid end component to the elongate couplers via the plate, which may improve the lifespan of the fluid end component. This may also create, or allow for, serviceability improvements, which are detailed below.

In at least some embodiments, the couplers position the cradle plate in a spaced relationship with the fluid end. For example, the couplers may each include an enlarged section that defines the spaced relationship of the cradle plate and the fluid end. As a specific example, each enlarged section may comprise a sleeve that is formed separately from an elongate main body of each of the couplers. Alternatively, a stuffing box of the fluid end may define the spaced relationship of the cradle plate and the fluid end. Regardless of how it is realized, this spaced relationship may ensure that the cradle plate is precisely positioned to support and secure the fluid end component and to transfer a load away from the fluid end component. Additionally or alternatively, the couplers may position the cradle plate in a spaced relationship with the power end. Again, the couplers may each include an enlarged section that defines the spaced relationship of the cradle plate and the power end, such as a sleeve that is formed separately from an elongate main body of each of the couplers. Thus, in some instances, one or more of the couplers of the set of elongate couplers may comprise a tie rod with a plurality of sleeves. In any case, the spaced relationship from power end may also ensure that the cradle plate is precisely positioned to support and secure the fluid end component and to transfer a load away from the fluid end component.

In at least some embodiments, the cradle plate further comprises a second set of openings, each of which are configured to receive a single pony rod of the power end, a single reciprocating element of the fluid end, or both the single pony rod and the single reciprocating element. In some of these embodiments, the fluid end component is annular and an outer surface of the fluid component has first threads. Meanwhile, openings of the second set of openings may each have a threaded inner wall that is configured to movably mate with the first threads of the fluid end component. The movable mating between the threads and the threaded inner wall may allow axial adjustment of the fluid end component with respect to the cradle plate. Thus, in some instances, a plate can be positioned to secure a fluid end component in a particular position with respect to a fluid end and the fluid end component can then be further tightened (or otherwise adjusted), at installation and/or over time, e.g., to create compression of a compressible or energizable seal.

Still further, in some embodiments, the fluid end comprises receivers for the couplers, with the receivers comprising through holes that extend from a front side of the fluid end casing to a back side of the fluid end casing. Thus, couplers can be secured to the fluid end at the back side of the fluid end casing. Since the back side of the fluid end casing is typically less obstructed than a front side of the fluid end casing, this arrangement may allow the couplers, and the cradle plate, to be easily installed or removed. Additionally or alternatively, the fluid end may include a removable stuffing box, the fluid end component may be a retaining nut, the seal may comprise one or more packing seals that are disposed in the removable stuffing box, and the cradle plate may secure the retaining nut against the one or more packing seals. In at least some of these embodiments, the cradle plate is spaced from the removable stuffing box when the cradle plate secures the retaining nut against the one or more packing seals. Thus, a load experienced by the fluid end component (e.g., the retaining nut) will transfer to the couplers via the cradle plate and will not transfer to the removable stuffing box (or will only minimally transfer to the removable stuffing box).

According to another embodiment, the present application is directed to a fluid end comprising a casing, a seal, and a component. The casing includes an inlet bore through which fluid may enter the casing, an outlet bore through which the fluid may exit the casing, and a reciprocation bore in which or adjacent which a reciprocating element can reciprocate to drive the fluid from the inlet bore to the outlet bore. The seal is formed around the reciprocating element in a position that prevents the fluid from leaking through the reciprocation bore and the seal is formed by a plurality of packing seals. The component is configured to secure the plurality of packing seals in the position and the component is positioned against the plurality of packing seals by a cradle plate that is positioned in a cradle defined between the fluid end and a power end driving operation of the reciprocating element. Among other advantages, securing the seal with a component in this manner will limit the load experienced by the component, thereby lessening wear and extending the life of the component. Securing the seal with a component in this manner also allows the seal to be quickly accessed for installation or removal, improving serviceability.

In at least some embodiments, the component is not directly coupled to the casing. Instead, the component may be secured (e.g., sandwiched) thereagainst, which ensures that the component can both transfer loads away from the casing and be quickly installed on or removed from the casing. Additionally or alternatively, the fluid end may include a removable stuffing box that at least partially houses the plurality of packing seals so that the position of the seal is in the reciprocation bore, coaxial with the reciprocation bore, or both. For example, the stuffing box may include a central opening that is coaxial with the reciprocation bore of the casing and the plurality of packing seals may be entirely housed within the removable stuffing box so that the plurality of packing seals are coaxial with the reciprocation bore of the casing. This may enable the seal to be quickly replaced by replacing the entire removable stuffing box (if desired) and/or may enable a user to quickly and easily access the plurality of packing seals. Such a location may also transfer wear away from the fluid end casing. Alternatively, the plurality of packing seals may be at least partially positioned in the reciprocation bore, and removing the stuffing box may provide quick and easy access to the plurality of packing seals.

In any case, in at least some embodiments where the fluid end includes a removable stuffing box, the removable stuffing box may be secured against the casing with a plurality of couplers and/or may secured against the casing by the cradle plate. When the removable stuffing box is secured against the casing by only the cradle plate, the removable stuffing box may removed or installed extremely quickly, which may improve serviceability of the fluid end and reduce downtime, as is explained in further detail below.

According to yet another embodiment, the present application is directed to a cradle plate that is installable within a cradle disposed between a power end of a high pressure reciprocating pump and a fluid end of the high pressure reciprocating pump. The cradle plate includes a main body that extends from a front surface to a back surface and a first set of openings that extend through the main body. The first set of openings are configured to receive a set of elongate couplers that position the cradle plate within the cradle in a position that secures a fluid end component against a casing of the fluid end, against a seal of the fluid end, or against both the casing and the seal. Thus, the cradle plate may realize the advantages discussed above in connection with the fluid end and reciprocating pump embodiments of the present application. Moreover, the cradle plate may include any of the features or structures described above in connection with a cradle plate and may realize the advantages of such features or structures.

The foregoing advantages and features will become evident in view of the drawings and detailed description.

BRIEF DESCRIPTION OF THE DRAWINGS

To complete the description and in order to provide for a better understanding of the present application, a set of drawings is provided. The drawings form an integral part of the description and illustrate embodiments of the present application, which should not be interpreted as restricting the scope of the invention, but just as examples. The drawings comprise the following figures.

Like reference numerals have been used to identify like elements throughout this disclosure.

DETAILED DESCRIPTION

The following description is not to be taken in a limiting sense but is given solely for the purpose of describing the broad principles of the invention. Embodiments of the invention will be described by way of example, with reference to the above-mentioned drawings showing elements and results according to the present invention.

Generally, the present application is directed to a cradle plate for a reciprocating pump. The cradle plate sits between the power and the fluid end and, more specifically, is positioned in a spaced relationship with both the fluid end and the power end. Additionally, and importantly, the cradle plate is positioned in the cradle in a position that secures one or more fluid end components against a casing of the fluid end, against a seal of the fluid end, or against both the casing and the seal. For example, the cradle plate may secure a retaining nut (i.e., a gland nut) against packing seals and/or a portion of a fluid end casing (e.g., a removable stuffing box). Additionally or alternatively, the cradle play may secure a removable stuffing box against a fluid end casing. To realize this position, the cradle plate may include openings that are mounted on elongate couplers that extend between the fluid end and the power end.

When the cradle plate secures one or more fluid end components in place for a fluid end, the cradle plate may transfer a load of the one or more fluid end component to the elongate couplers. This load transfer may extend the lifespan of the one or more fluid end components which it secures for the fluid end. The load transfer may also decrease the overall costs of owning and maintaining a fluid end and/or reciprocating pump. Additionally, the cradle plate may improve the serviceability of the fluid end and/or reciprocating pump because the cradle plate may allow the one or more fluid end components to be installed on or removed from a fluid end very quickly.

Figure 1:
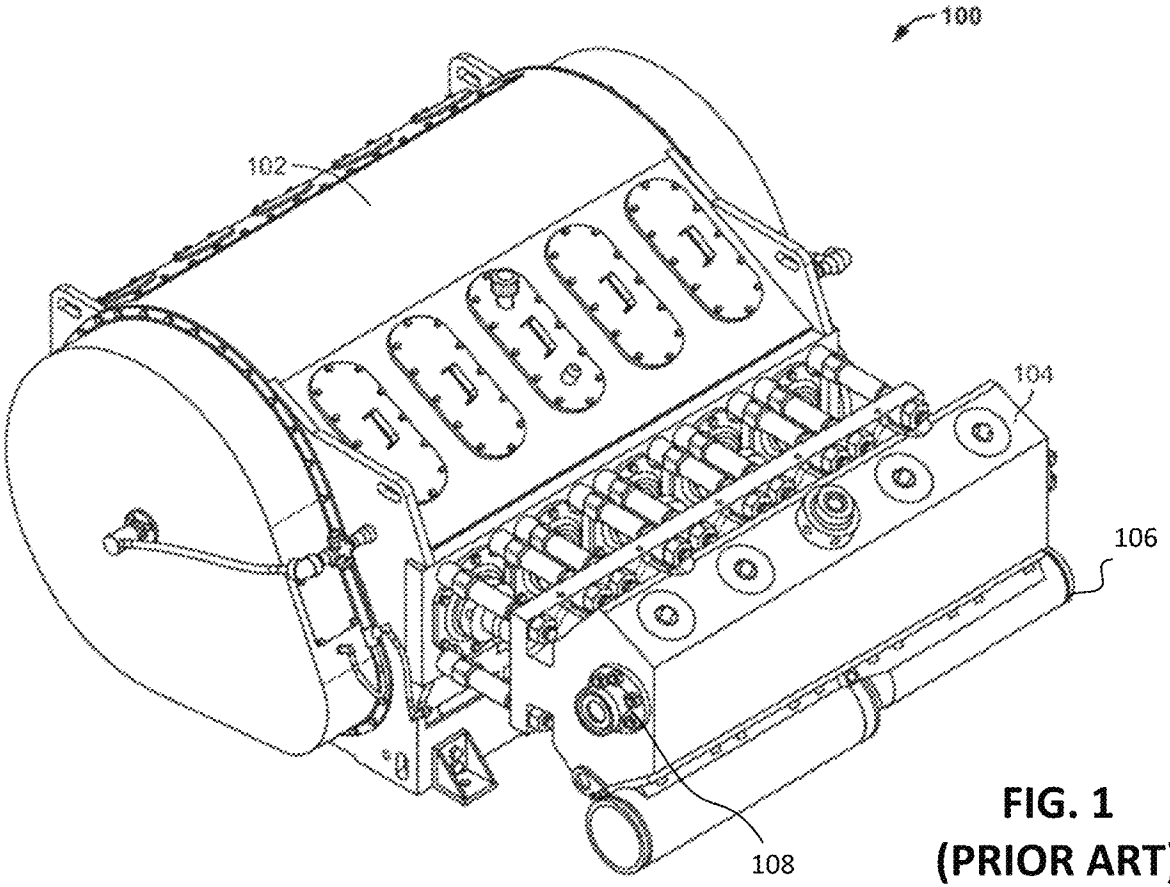
FIG. 1 (PRIOR ART)
FIG. 1 is a front perspective view of a prior art reciprocating pump including a fluid end and a power end.

Referring to FIG. 1, a prior art reciprocating pump 100 is illustrated. The reciprocating pump 100 includes a power end 102 and a fluid end 104. The power end 102 includes a crankshaft that drives a plurality of reciprocating plungers or pistons (generally referred to as "reciprocating elements") within the fluid end 104 to pump fluid at high pressure (e.g., to cause the fluid end 104 to deliver high pressure fluids to earth drilling operations). For example, the power end 102 may be configured to support hydraulic fracturing (i.e., fracking) operations, where fracking liquid (e.g., a mixture of water and sand) is injected into rock formations at high pressures to allow natural oil and gas to be extracted from the rock formations. However, to be clear, this example is not intended to be limiting and the present application may be applicable to both fracking and drilling operations. At the same time, the present invention may also offer some specific advantages for hydraulic fracturing, which may be noted herein where applicable.

In any case, often, the reciprocating pump 100 may be quite large and may, for example, be supported by a semi-tractor truck ("semi") that can move the reciprocating pump 100 to and from a well. Specifically, in some instances, a semi may move the reciprocating pump 100 off a well when the reciprocating pump 100 requires maintenance. However, a reciprocating pump 100 is typically moved off a well only when a replacement pump (and an associated semi) is available to move into place at the well, which may be rare. Thus, often, the reciprocating pump is taken offline at a well and maintenance is performed while the reciprocating pump 100 remains on the well. If not for this maintenance, the reciprocating pump 100 could operate continuously to extract natural oil and gas (or conduct any other operation). Consequently, any improvements that extend the lifespan of components of the reciprocating pump 100, extend the time between maintenance operations (i.e., between downtime), and/or minimize the time needed to complete maintenance operations (minimizing downtime) are highly desirable.

Figure 2:
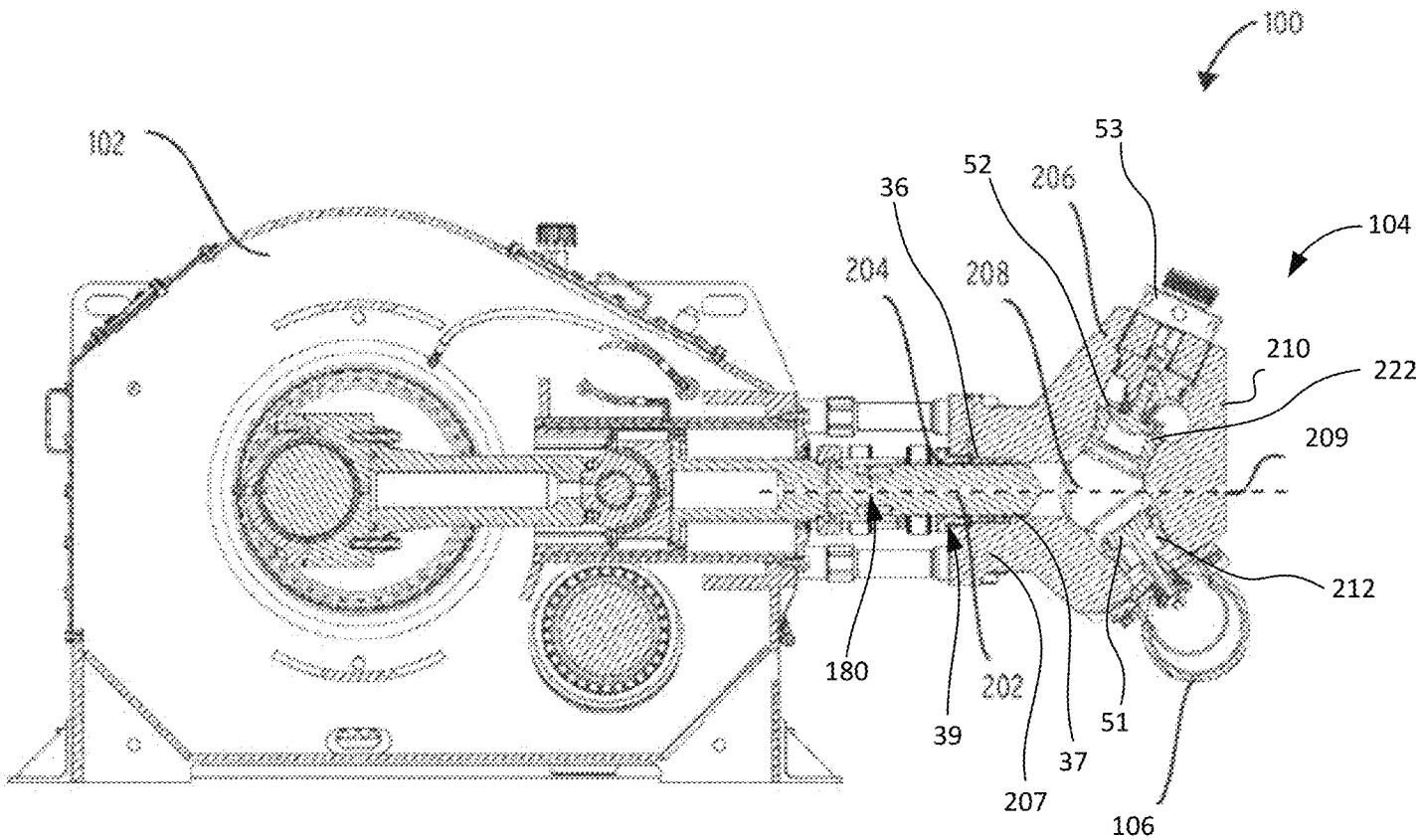
FIG. 2 (PRIOR ART)
FIG. 2 is a side cross-sectional view of the prior art reciprocating pump of FIG. 1.
Figure 3A:
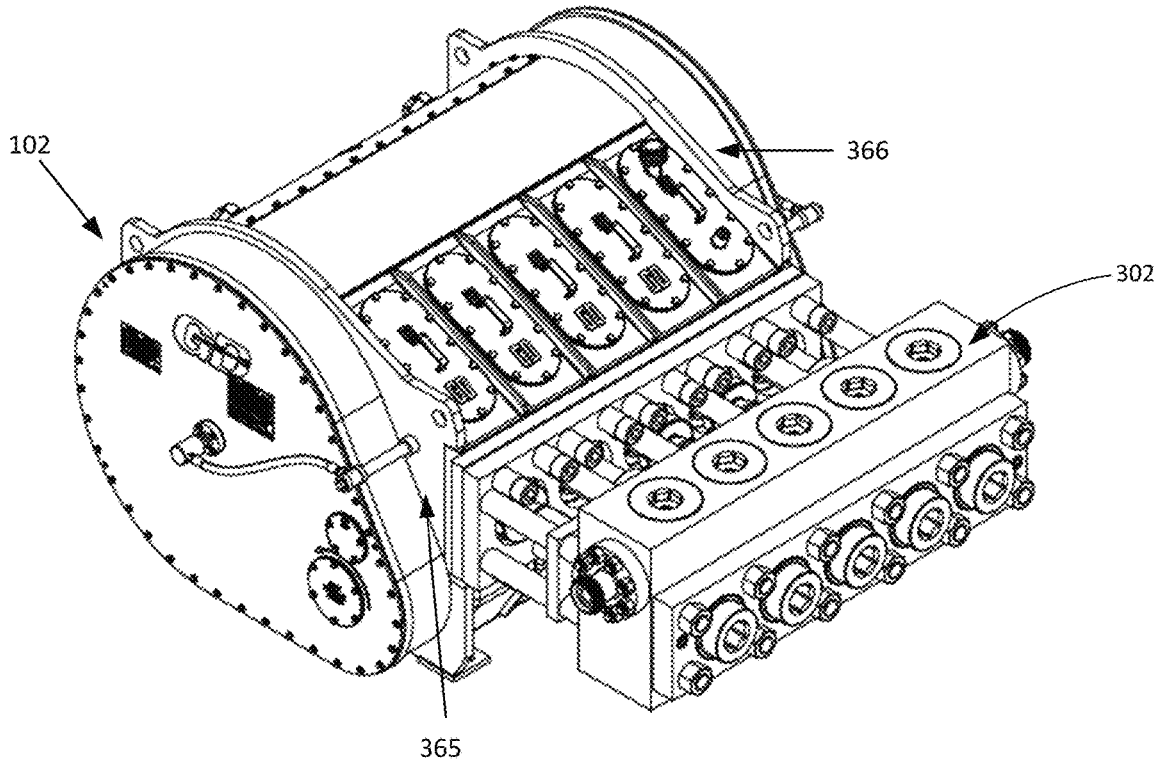
FIG. 3A is a front perspective view of a reciprocating pump including a cradle plate, according to an example embodiment of the present application.
Figure 3B:
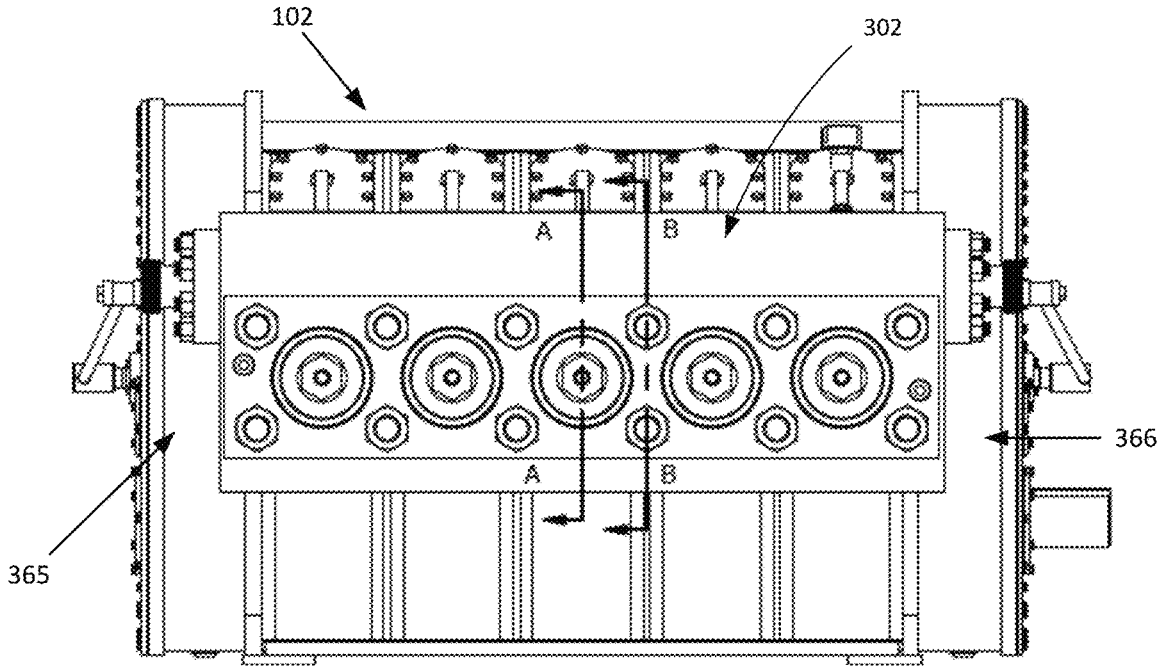
FIG. 3B is a front view of the reciprocating pump illustrated in FIG. 3A.
Figure 4:
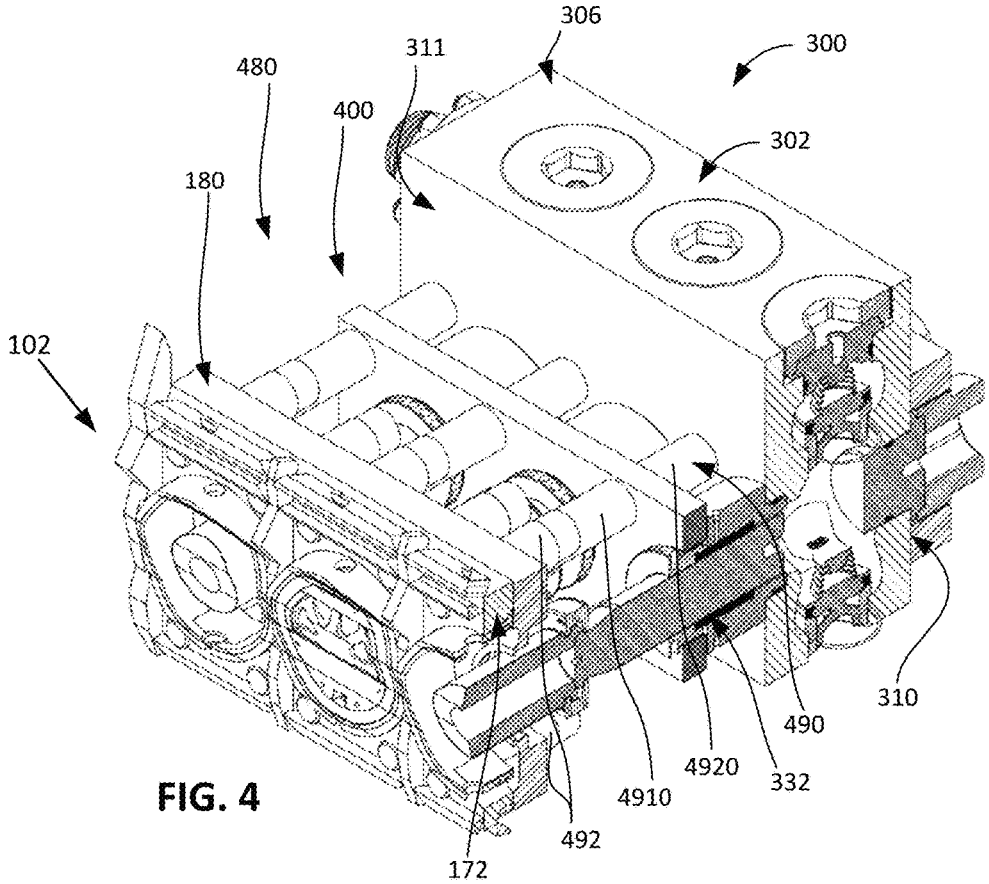
FIGS. 4 and 5 are perspective and side cross-sectional views, respectively, of the reciprocating pump illustrated in FIGS. 3A and 3B taken along line "A-A" of FIG. 3B.

Still referring to FIG. 1, but now in combination with FIG. 2, the reciprocating pump 100 pumps fluid into and out of pumping chambers 208. FIG. 2 shows a side, cross-sectional view of reciprocating pump 100 taken along a central axis 209 of one of the reciprocating elements 202 included in reciprocating pump 100. Thus, FIG. 2 depicts a single pumping chamber 208. However, it should be understood that a fluid end 104 can include multiple pumping chambers 208 arranged side-by-side. In fact, in at least some embodiments (e.g., the embodiment of FIG. 1), a casing 206 of the fluid end 104 forms a plurality of pumping chambers 208 and each chamber 208 includes a reciprocating element 202 that reciprocates within the casing 206. However, side-by-side pumping chambers 208 need not be defined by a single casing 206. For example, in some embodiments, the fluid end 104 may be modular and different casing segments may house one or more pumping chambers 208. In any case, the one or more pumping chambers 208 are arranged side-by-side so that corresponding conduits are positioned adjacent each other and generate substantially parallel pumping action. Specifically, with each stroke of the reciprocating element 202, low pressure fluid is drawn into the pumping chamber 208 and high pressure fluid is discharged. But, often, the fluid within the pumping chamber 208 contains abrasive material (i.e., "debris") that can damage seals formed in the reciprocating pump 100, such as the "packing seals" surrounding a reciprocating element 202 of a fracking fluid end, creating a need for continued maintenance.

In various embodiments, the fluid end 104, and specifically the fluid end casing 206, may be shaped differently and/or have different features, but may still generally perform the same functions, define similar structures, and house similar components. For example, while fluid end 104 includes a first bore 204 that intersects an inlet bore 212 and an outlet bore 222 at skewed angles, other fluid ends may include any number of bores arranged along any desired angle or angles, for example, to intersect bore 204 (and/or an access bore) substantially orthogonally and/or so that two or more bores are substantially coaxial. Generally, bores 212 and 222, as well as any other bores (i.e., segments, conduits, etc.), may intersect to form a pumping chamber 208, may be cylindrical or non-cylindrical, and may define openings at an external surface 210 of the casing 206. Additionally, bores 212 and 222, as well as any other bores (i.e., segments, conduits, etc.), may receive various components or structures, such as sealing assemblies or components thereof.

In the depicted embodiment, inlet bore 212 defines a fluid path through the fluid end 104 that connects the pumping chamber to a piping system 106 delivering fluid to the fluid end 104. Meanwhile, outlet bore 222 allows compressed fluid to exit the fluid end 104. Thus, in operation, bores 212 and 222 may include valve components 51 and 52, respectively, (e.g., one-way valves) that allow bores 212 and 222 to selectively open and deliver a fluid through the fluid end 104. Typically, valve components 51 in the inlet bore 212 may be secured therein by a piping system 106 (see FIG. 1). Meanwhile valve components 52 in outlet bore 222 may be secured therein by a closure assembly 53 that, in the prior art example illustrated in FIG. 2, is removably coupled to the fluid end 104 via threads.

In operation, fluid may enter fluid end 104 via outer openings of inlet bores 212 and exit fluid end 104 via outer openings of outlet bores 222. More specifically, fluid may enter inlet bores 212 via pipes of piping system 106, flow through pumping chamber 208 (due to reciprocation of a reciprocating elements 202), and then flow through outlet bores 222 into a channel 108 (see FIG. 1). However, piping system 106 and channel 108 are merely example conduits and, in various embodiments, fluid end 104 may receive and discharge fluid via any number of pipes and/or conduits, along pathways of any desirable size or shape.

Meanwhile, each of bores 204 defines, at least in part, a cylinder for reciprocating elements 202, and/or connects the casing 206 to a cylinder for reciprocating elements 202. More specifically, in the illustrated embodiment, a casing segment 207 houses a packing assembly 36 configured to seal against a reciprocating element 202 disposed interiorly of the packing assembly 36 and prevent fluid from leaking through reciprocation bore 204. Reciprocation of a reciprocating element 202 in or adjacent to bore 204, which may be referred to as a reciprocation bore (or, for fracking applications, a plunger bore), draws fluid into the pumping chamber 208 via inlet bore 212 and pumps the fluid out of the pumping chamber 208 via outlet bore 222. However, over time, the packing assembly 36 will wear and/or fail, and thus, must be accessed for maintenance and/or replacement. Other components, such as valve components 51 and/or 52, or the fluid end casing 206 itself may also wear and/or fail and require repair or replacement over time. To help provide access to these parts and/or the pumping chamber, some fluid ends have access bores that are often aligned with (and sometimes coaxial with) the reciprocating bore 204. Other fluid ends needs not include access bore and, thus, such an access bore is not illustrated in FIGS. 1 and 2.

Regardless of whether the fluid end includes an access bore, the packing assembly 36 typically needs to be replaced from an outer opening of bore 204 (i.e., a side of bore 204 aligned with the external surface 210 of the casing 206). At the same time, to operate properly, the packing assembly 36 must be securely positioned around the reciprocating element 202, either in or proximate to the reciprocation bore 204. Thus, in many prior art embodiments, the reciprocation bore 204 defines a stuffing box 37, e.g., in the form of a stepped cavity wall. Then, a closure component 39, such as a sleeve or retaining nut, retains the packing assembly 36 (e.g., a set of packing rings) in the stuffing box 37. Alternatively, in some prior art embodiments, a removable stuffing box is removably coupled to a fluid end and defines, or at least partially defines, a stuffing box 37 for a packing assembly 36. However, since the packing assembly 36 often wears much faster than then removable stuffing box, the removably stuffing box must be openable to allow the packing assembly 36 to be replaced or repaired. Thus, removable stuffing boxes are often removably sealed by a component, such as a retaining nut (also referred to as a gland nut) that is removably attachable to the removable stuffing box.

In the former instances (e.g., where a closure component 39 retains the packing assembly 36 in a stuffing box 37 defined by the fluid end 104), the closure component 39 may experience a high load of forces (i.e., high stress). Thus, the closure component 39 must be tightly and securely coupled to the fluid end casing 106, e.g., with threads and/or bolts, and may wear out quickly over time. Meanwhile, in the latter instances (e.g., where a removable stuffing box is removably coupled to a fluid end), both the removably stuffing box and the closure component 39 (e.g., a retaining or gland nut) may experience a high load of forces. Thus, the removable stuffing box must be tightly and securely coupled to the fluid end casing 106, e.g., with threads and/or bolts, and the closure component 39 (e.g., a retaining or gland nut) must be tightly and securely coupled to the removable stuffing box. But, even with such connections, portions of the removable stuffing box and the closure component 39 may wear out quickly over time.

Now turning to FIGS. 3A, 3B, 4, and 5, the present application provides techniques that allow one or more fluid end components to be coupled to a fluid end casing with a reduced amount of stress acting on the components. This is generally realized by adding a cradle plate 400 into a cradle 480 defined between the power end 102 and a fluid end 302 coupled thereto. The cradle plate 400 is supported by the elongate couplers 490 that couple the power end 102 to the casing 306 of the fluid end 302 and the cradle plate 400 is mechanically coupled to one or more components 334 that retain seals for the fluid end 302. Advantageously, the cradle plate 400 can transfer a load from one or more components 334 which it is supporting to the elongate couplers 490.

In the embodiment depicted in FIGS. 3A, 3B, 4, and 5, the fluid end component 334 is a retaining nut or gland nut that secures packing seals 332 in a removable stuffing box 330. However, to be clear, this is merely one example of a component with which the techniques presented herein may be utilized and, overall, components 334 may include components that are coupleable to the fluid end casing 306, such as retaining nuts, as well as portions of the fluid end 302 that are generally referred to as forming a part of the fluid end casing 306, such as removable stuffing boxes. Similarly, the packing seals 332 are one example of a seal that be retained by a component that is secured in place with respect to a casing 306 by way of the techniques presented herein.

In order to realize the aforementioned load transfer (e.g., to transfer forces from components 334 to elongate couplers 490), the cradle plate 400 is carefully positioned in the cradle 480 so that the cradle plate 400 securely and stably supports the fluid end component 334 in a position where it retains one or more seals for the fluid end 302. More specifically, in the embodiment depicted in FIGS. 3A, 3B, 4, and 5, the elongate couplers 490 each include an elongate main body 4901 that extends through the plate 400, a first enlarged section 4910 positioned between the plate 400 and the power end 102, and a second enlarged section 4920 positioned between the plate 400 and the fluid end 302.

Enlarged sections 4910 and 4920 both have diameters that are larger than a diameter of the elongate main body 4901 and larger than diameters of openings 410 (see FIG. 7) in the plate 400 through which the elongate main body 4901 extends. Thus, enlarged sections 4910 and 4920 can restrict movement of the plate 400 along the elongate main body 4901 and precisely position the plate 400 with respect to the fluid end casing 306 and/or a removable stuffing box 330 coupled thereto.

In some instances, enlarged sections 4910 and 4920 are specifically sized for specific components intended to be used with a certain power end 102 and/or fluid end 302. Alternatively, enlarged sections 4910 and 4920 may have lengths that are adjustable and/or easily customized by an end user. For example, enlarged sections 4910 and 4920 may each be sleeves that are formed separately from an elongate main body 4901 of each of the couplers 490 and, thus, may be adjustable with relatively simple machining operations (e.g., with a single cut). In the depicted embodiment, enlarged sections 4910 and 4920 are each formed by sleeves that have a predefined length and are slidable along the elongate main body 4901 of each of the couplers 490.

In the depicted embodiment, the fluid end component 334 may be abutting, and potentially compressing, the packing seals 332 of the fluid end 302 when enlarged sections 4910 and enlarged sections 4920 properly position the plate 400 in the cradle 480. In some embodiments, the plate 400 fixedly supports the fluid end component 334; however, in other embodiments, the plate 400 may movably support the fluid end component 334. For example, in the embodiment depicted in FIGS. 3A, 3B, 4, and 5, the fluid end component 334 may include first threads 335 (see FIGS. 6 and 11) that may movably mate with threaded inner walls 421 of second openings 420 included on the plate 400.

Thus, fluid end component 334 may be longitudinally adjustable with respect to the plate 400. That is, a threaded connection between the fluid end component 334 and the plate 400 may allow the fluid end component 334 to move incrementally towards or away from a front side 311 of the fluid end casing 306. In turn, this longitudinal movement (which may also be referred to as axial movement), moves the fluid end component 334 towards or away from the removable stuffing box 330 and the packing seals 332 installed therein). Thus, if the seal that is retained by the fluid end component 334 is energizable (e.g., compressible), like many known packing seals, the fluid end component 334 may move towards the seal and energize the seals. In fact, over time, the fluid end component 334 may be moved incrementally closer to further compress and further energize (or re-energize) an energizable seal.

As mentioned, since the plate 400 is supported by elongate couplers 490, stress imparted to the fluid end component 334, e.g., during or after application of compression, may be transferred from fluid end component 334 to the elongate couplers 490 via the plate 400. To further amplify the benefits of this load transfer, the plate 400 may be separated from the removable stuffing box 330 and/or the fluid end casing 306. This separation may encourage the full load imparted to the fluid end component 334, or as much of load as possible, to transfer to the elongate couplers 490, e.g., instead of transferring back to the removable stuffing box 330 and/or the fluid end casing 306.

Figure 10:
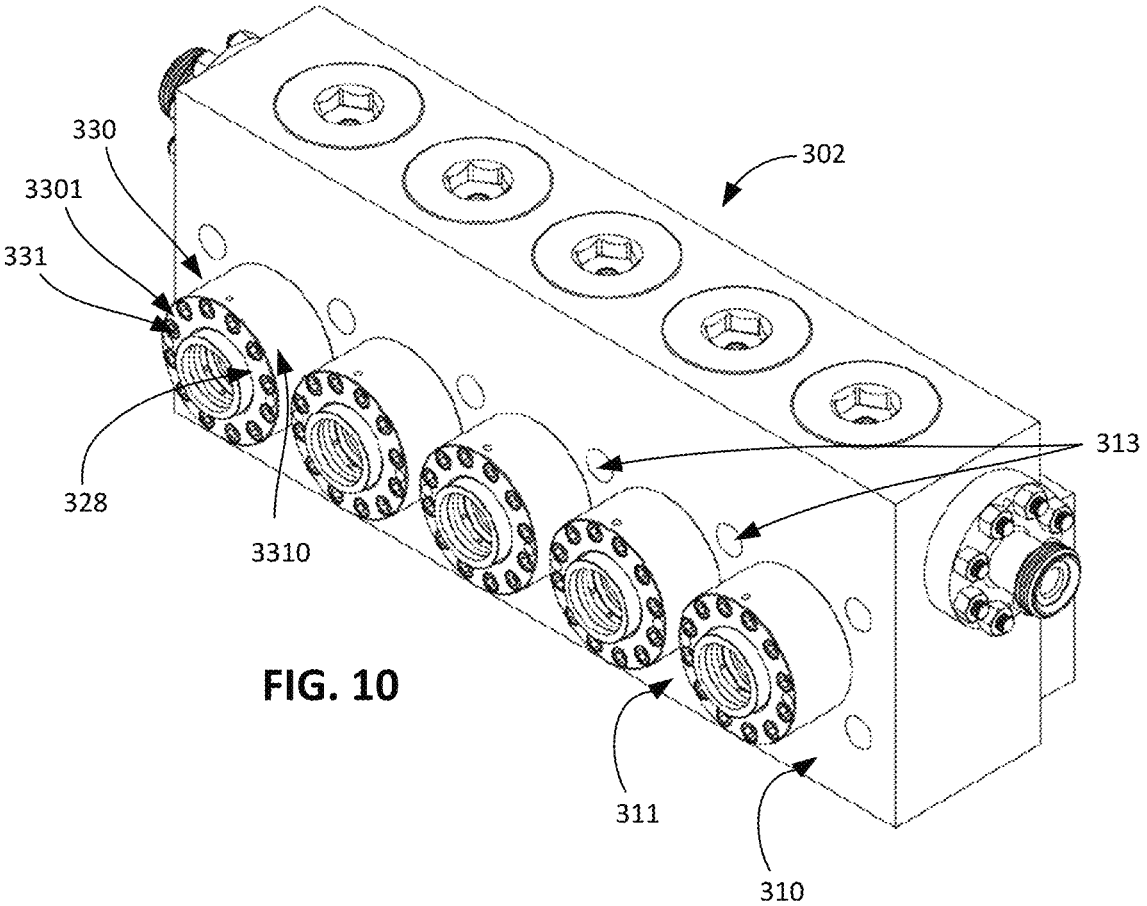
FIG. 10 is a front perspective view of a fluid end component secured against the fluid end of the reciprocating pump illustrated in FIGS. 3A, 3B, 4, and 5.

Notably, reducing the load experienced by the removable stuffing box 330 may allow the removable stuffing box 330 to be coupled to the fluid end casing 306 with fewer and/or weaker couplers 331 (e.g., bolts, see FIG. 10). Reducing the quantity of couplers 331 installed or removed in a quicker operation (e.g., as compared to a higher quantity of couplers 331) will improve the serviceability of the fluid end 302 because it will reduce the downtime required to remove and/or replace the removable stuffing box 330. Since stuffing box replacement or servicing (e.g., to replace packing seals 332) is a somewhat common service operation, even minor improvements of service time are often critical. Additionally or alternatively, reducing the load experienced by the removable stuffing box 330 and/or the fluid end casing 306 may reduce wear on these components, extending the lifespan of the removable stuffing box 330 and/or the fluid end casing 306 (e.g., by preserving the surfaces of the reciprocation bore 328 over time).

Figure 9:
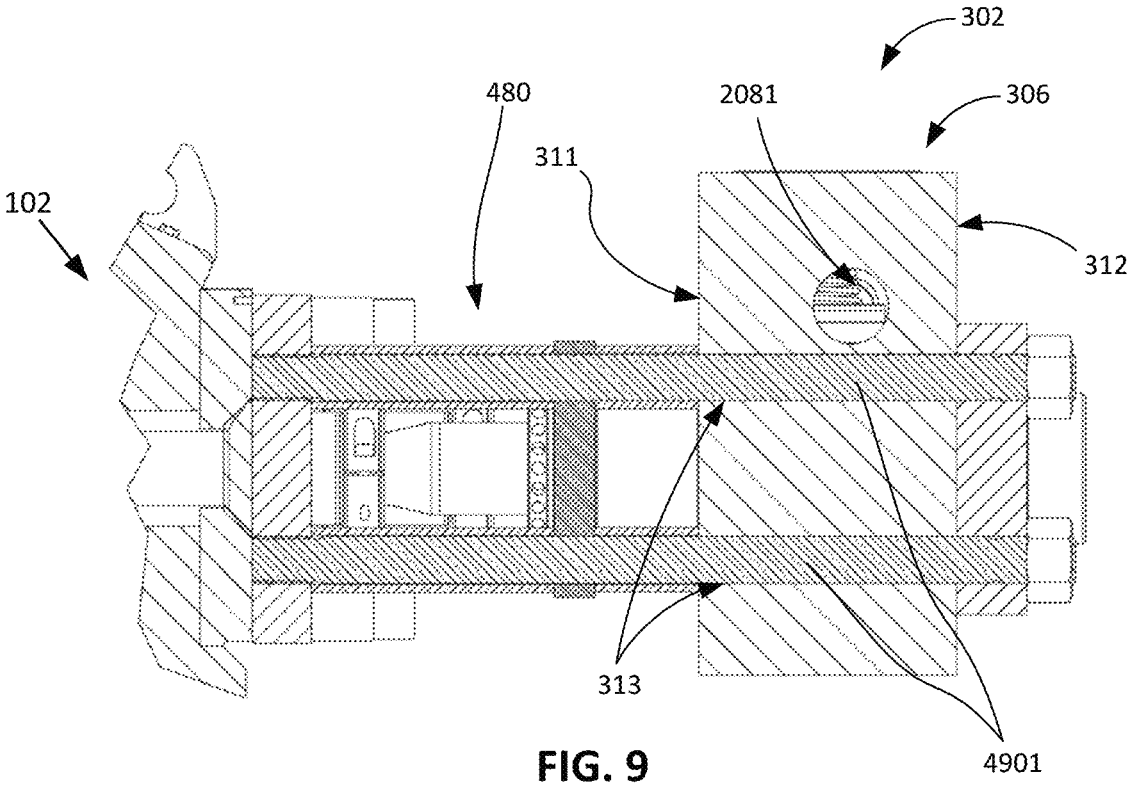
FIG. 9 is a side, sectional view of the fluid end of the reciprocating pump illustrated in FIGS. 3A, 3B, 4, and 5 taken along line "B-B" of FIG. 3B.

As an example of separation between the plate 400 and the removable stuffing box 330, in the depicted embodiment, the plate 400 is separated from a front end 3301 (see FIG. 9) of the removable stuffing box 330 by approximately 1/16 of an inch. However, in other embodiments, this gap can be smaller or larger, such as in a range of approximately 1/32 of an inch to approximately one inch, including the boundaries of this range. Regardless of the size of this gap, this gap need not be defined by one particular component and can be defined by dimensions of enlarged sections 4920, enlarged sections 4910, stuffing box 330, and/or by a position of fluid end component 334 with respect to a front surface 404 (which faces the fluid end 302) of the plate 400. For example, enlarged sections 4920 might initially define a gap between plate 400 and the front end 3301 of the removable stuffing box 330 and the fluid end component 334 might then be longitudinally adjusted with respect to plate 400 to further adjust the size of the gap, e.g., prior to commencing pumping operations. Alternatively, enlarged sections 4910 may not define a gap between plate 400 and the front end 3301 of the removable stuffing box 330 (i.e., enlarged sections 4910 might allow plate 400 to abut the front end 3301 of the removable stuffing box 330) and the fluid end component 334 might then be longitudinally adjusted with respect to plate 400 to create a gap, e.g., prior to commencing pumping operations.

Still referring to FIGS. 3A, 3B, 4, and 5, in the depicted embodiment, as well as other embodiments of the present application, the plate 400 is depicted in use with the prior art power end 102. This is not intended to be limiting in any way; instead, the power end 102 is one example power end with which the plate 400 may be used. Likewise, in FIGS. 3A, 3B, 4, and 5, as well as other embodiments of the present application, the plate 400 is depicted in use with a fluid end casing 306 that has an external surface 310 that is substantially cuboidal and this is also not intended to be limiting in any way. Instead, the fluid end casing 306 is one example casing with which the plate 400 may be used and, generally, it is envisioned that the plate 400 may be utilized with any power end that is coupled to any fluid end by elongate couplers, such as elongate couplers 490 (e.g., tie rods). Additionally or alternatively, the techniques presented herein may be embodied as a power end that includes plate 400 or a fluid end that includes plate 400. Nevertheless, for completeness, the depicted fluid end 302 and the depicted power end 102 are both described, at least briefly below, e.g., to highlight advantages created by use of plate 400 with power end 102 and fluid end 302.

First, in the embodiment depicted in FIGS. 3A, 3B, 4, and 5, the fluid end casing 306 is a flangeless fluid end casing that can receive the removable stuffing box 330 on or in its reciprocation bore 328, e.g., to extend and/or form a portion of reciprocation bore 328. As can be seen best in FIG. 5, in the depicted embodiment, the reciprocation bore 328 extends perpendicular to an inlet bore 322 and an outlet bore 324 and is substantially coaxial with an access bore 326. Each of these bores extends from an external surface 310 of a casing 306 to a cross-bore or pumping chamber, with the reciprocation bore 328 extending to a front side 311 of the casing 306 and the access bore 326 extending to a back side 312 of the casing 306. Meanwhile, the inlet bore 322 and an outlet bore 324 may extend substantially vertically and may house valve components that allow fluid to selectively flow through the fluid end 302. However, the shape, orientation, alignment, etc. of the external surface 310 and bores 322, 324, 326, and 328 are merely examples and, in other embodiments, the fluid end casing 306 may include any desirable features, components, shaping, alignment, etc. In fact, any description of fluid end 104 included above should be understood to apply to like and/or similar parts of fluid end 302.

But, with the plate 400 presented herein, it may be beneficial to utilize a fluid end casing that is at least similar to fluid end casing 306 (e.g., flangeless) because the plate 400 may extend the lifespan of the removable stuffing box 330 and/or the fluid end component 334 coupled thereto, which is sometimes a failure point for fluid ends that utilize removable stuffing boxes. Then, advantages of such a fluid end might be realized without the disadvantage of a fluid end component 334 and/or removable stuffing box 330 with a short lifespan. For example, when the fluid end 302 includes a removable stuffing box 330, the casing 306 can be smaller and the external surface 310 can be substantially cuboidal, which may reduce the cost of materials needed to form the casing 306 and/or reduce the costs of manufacturing the casing 306. As a specific example, the casing 306 need not require a large forging and careful machining to form a flange that is coupleable to a power end 102, which is a timely and expensive operation. Here, since plate 400 is effective when resting on elongate couplers 490 that extend from the power end 102 to the fluid end 302, the plate 400 may render such a flange and the associated machine time unnecessary. However, at the same time, the plate 400 may also be utilized with flanged fluid ends if desired, provided that such designs utilize elongate couplers extending between a power end and a fluid end.

Next, while FIGS. 3A, 3B, 4, and 5 depict a removable stuffing box 330 that can be coupled to the casing 306 with couplers (e.g., bolts), other embodiments might realize the advantages of plate 400 with a removable stuffing box 330 that is coupleable to a fluid end casing 306 with threads and/or any other retaining techniques. Additionally or alternatively, while FIGS. 3A, 3B, 4, and 5 show the removable stuffing box 330 entirely support packing seals 332 (e.g., independently of the casing 306), the removable stuffing box 330 need not entirely support packing seals 332 to realize the advantages of plate 400 described herein. For example, a removable stuffing box 330 may support packing seals 332 in combination with a step defined in the reciprocation bore 328 and a fluid end component 334 coupled to plate 400 may still secure the packing seals 332 in place and realize the advantages discussed herein (e.g., load transfer to elongate couplers 490).

Still further, the advantages of plate 400 might be realized without a removable stuffing box 330. For example, plate 400 might be used to securely position a fluid end component 334 that is installed in or on the reciprocation bore 328 of a fluid end casing 306 to lock a seal against a fluid end and/or against a sleeve. Put simply, removable stuffing box 330 is merely one example of a component that may support a seal for a fluid end until the seal is secured in place by a fluid end component 334 supported by the plate 400. Thus, the removable stuffing box 330 is not intended to be limiting in any way. On the other hand, as is described in further detail below, in some embodiments, a removable stuffing box may comprise the fluid end component that is secured to a fluid end casing 306 with plate 400.

That all said, when the packing seals 332 are fully supported by a removable stuffing box 330, specific geometries of a fluid end bore (e.g., reciprocation bore 328) need not support the packing seals and it will be unlikely that an end user will need to carefully monitor and/or repair the fluid end with expensive and timely maintenance operations (e.g., weld repairs). This will also reduce downtime—an end user can replace the removable stuffing box 330 much faster than an end user can repair a washed out fluid end bore. Moreover, if the packing seals 332 are fully supported by a removable stuffing box 330, wear created from debris and fluid contacting a seal location will likely concentrate on the removable stuffing box 330 instead of the fluid end casing 306, eliminating, or at least reducing, the likelihood that the a fluid end bore defined by casing 306 experiences wear and/or washes out.

Finally, in the depicted embodiment, the power end 102 is depicted as having a nose plate 172 that is coupled to a mount plate 180. The mount plate 180 expands the compatibility of the nose plate 172 by allowing elongate couplers 490 to connect to the power end 102 in more locations that the specific locations defined by receptacles (not shown) of the nose plate 172. Additionally, the mount plate 180 allows a wide variety of elongate couplers 490 (e.g., different sizes and/or different connection types) to connect to the power end 102. Thus, the mount plate 180 may be beneficial for the plate 400 because it may allow relatively thick (and, thus, strong) elongate couplers 490 to extends between the power end 102 and the fluid end 302. However, in other embodiments, the power end 102 may support a plate 400 regardless of whether the power end 102 includes a mount plate 180, provided that elongate couplers 490 can be coupled to the power end 102 in some manner.

That said, when the power end 102 includes a mount plate 180, a second set of couplers 492 extend through the mount plate 180 in a first direction (towards the power end 102) to couple the mount plate 180 to the nose plate 172 while elongate couplers 490 extend through the plate 400 in a second direction to couple the mount plate 180 to fluid end 302. Thus, while the second set of couplers 492 needs to be positioned to match a configuration of the receptacles (not shown) included on the nose plate 172, the first set of elongate couplers 490 are free to be positioned in any desired configuration or location, for example, to allow the power end 102 to be connected to fluid end 302 and/or any other desirable fluid end. In fact, with the mount plate 180, the cradle 480 may be large enough and/or provide enough space (e.g., between elongate couplers 490) that a reciprocation bore 328 of fluid end 302 can be serviced without fully disconnecting the fluid end 302 from the power end 102. Instead, the fluid end 302 might be only partially disconnected from the power end 102 during servicing/maintenance. For example, a reciprocation element 202 could be disconnected from a pony rod 185 of the power end 102 (e.g., by disconnecting a clamp 495 coupling the pony rod 185 to the reciprocation element 202), and the reciprocation bore 328 and/or components installed therein/thereon could be serviced or replaced without any further disassembly of the fluid end 302 or power end 102. As a specific example, the size and/or open space of the cradle 480 may enable the removable stuffing box 330 to be serviced and/or replaced without fully disconnecting the fluid end 302 from the power end 102.

Figure 5:
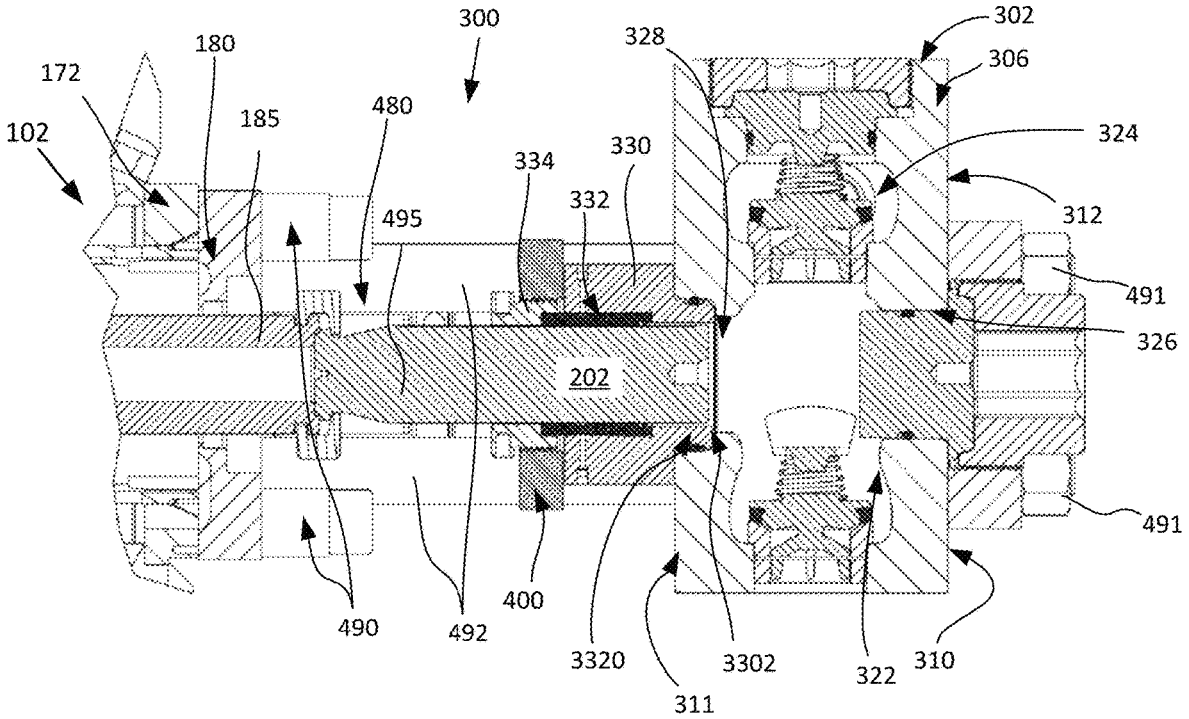
Figure 6:
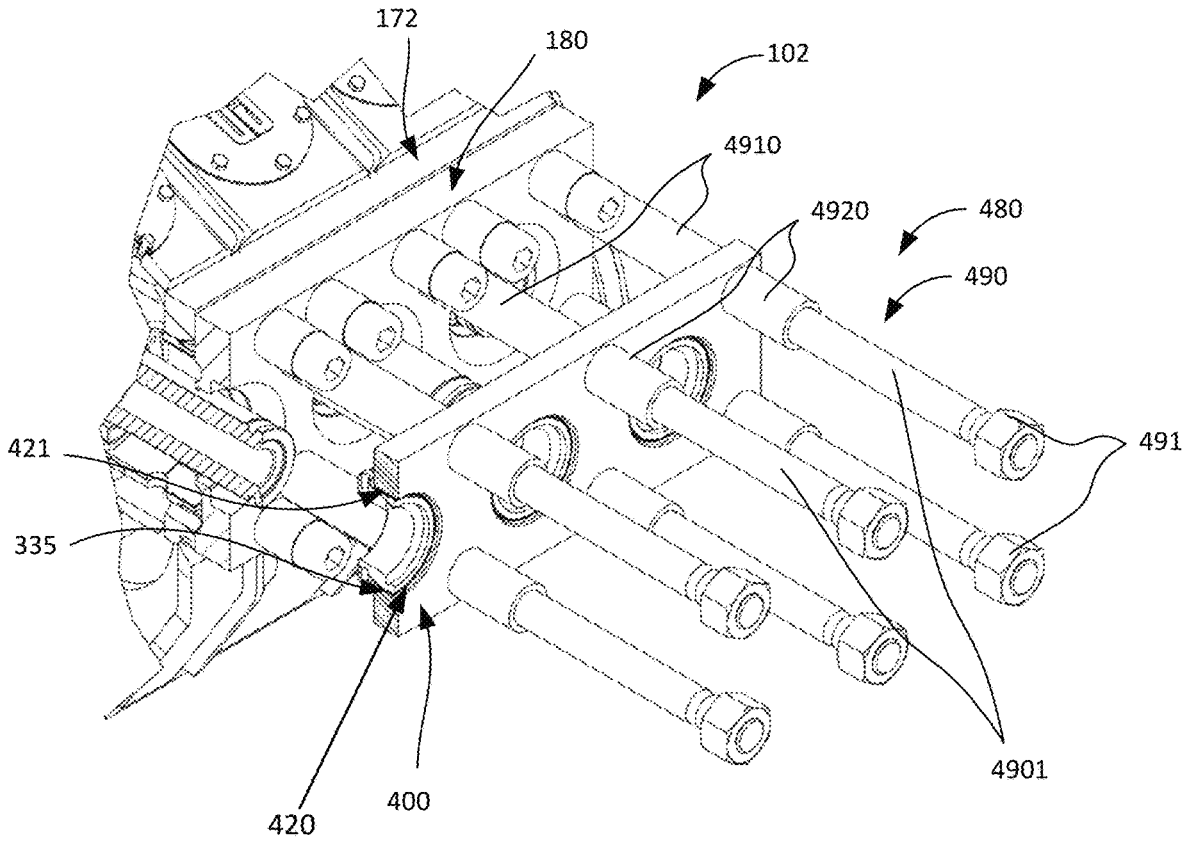
FIG. 6 is a perspective cross-sectional view of the reciprocating pump illustrated in FIGS. 3A and 3B taken along line "A-A" of FIG. 3B, but with the fluid end removed.

Now turning to FIG. 6, which depicts the reciprocating pump 300 of FIGS. 3A, 3B, 4, and 5 with the fluid end 302 disconnected, in addition to the foregoing advantages (e.g., load transfer), the plate 400 may provide further benefits when the reciprocating pump 300 is disassembled, e.g., to repair or replace the fluid end casing 306. As can be seen in FIG. 6, when the fluid end 302 is disconnected from the power end 102, the plate 400 and any fluid end component 334 coupled thereto can remain connected to the power end 102. This will reduce the cost of owning the reciprocating pump 300, both because the fluid end 302 can be replaced while replacing one less part and because the size of a fluid end casing 306 that needs to be replaced will be reduced.

It may be possible to leave the plate 400 (and the components 334) connected to the power end 102 because of at least two reasons. First, the load transfer provided by the plate 400 may extend the lifespan of the fluid end component 334 such that it lasts longer than a fluid end 302, or at least the casing 306, with which it is utilized. Second, since the plate 400 need not be fixedly coupled to the fluid end 302, the plate 400 need not be removed from the fluid end 302 prior to removal of the fluid end 302 from the power end 102. Thus, removing the fluid end 302 without the plate 400 need not be slowed by a first removal process, as would be needed if the plate 400 and/or the fluid end component 334 were coupled directly to the fluid end 302 (e.g., with bolts, threads, etc.). Instead, the fluid end component 334 is positioned against the fluid end 302 or a component thereof (e.g., against the removable stuffing box 330) without any direct mechanical coupling being formed between the fluid end component 334 and the fluid end 302.

Moreover, with the specific embodiment depicted in FIGS. 3A, 3B, and 4-6, the fluid end 302 can be disconnected from the power end 102, e.g., for complex servicing and/or repair, by decoupling elongate couplers 490 from the casing 306. In the depicted embodiment, this can be done by removing nuts 491 from a second or distal end 4902 of the elongate main body 4901 of elongate couplers 490. Then, the fluid end 302 can be disconnected from the power end 102 without decoupling the elongate couplers 490 from mount plate 180 which, in turn, remains mounted to the nose plate 172 with couplers 492. Importantly, removing the fluid end fluid end 302 from the power end 102 while leaving elongate couplers 490 in place will eliminate, or at least reduce, the risk of stripping the couplers 492 (which couple mount plate 180 to the nose plate 172) or the receptacles of the nose plate 172. This is important because the nose plate 172 is often irremovably coupled to a crosshead assembly of a power end 102 and, thus, replacing or repairing the nose plate 172 (e.g., by repairing a stripped receptacle) is often extremely difficult (if not impossible).

Figure 7:
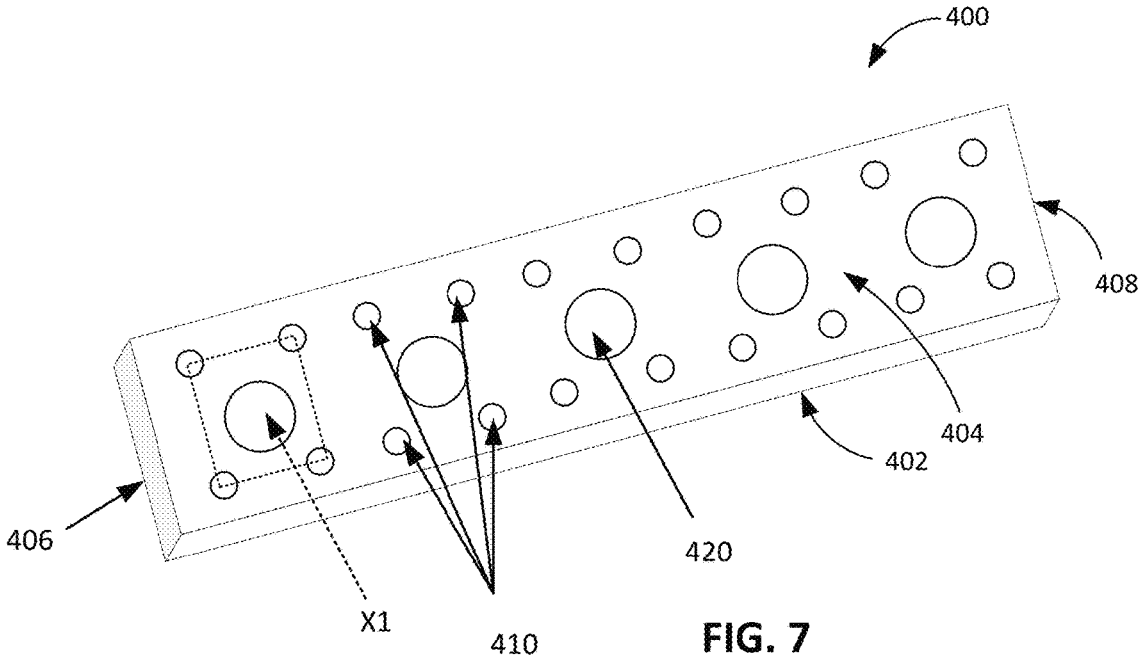
FIG. 7 is a front perspective view of the cradle plate included in the reciprocating pump of FIGS. 3A, 3B, 4, and 5.

Now turning to FIG. 7, which depicts plate 400 independent of reciprocating pump 300, the plate 400 includes a first set of openings 410 configured to receive the set of elongate couplers 490, e.g., tie rods. As mentioned, elongate couplers 490 couple the plate 400 to the fluid end 302 in a spaced relationship (e.g., with the spacing defined by enlarged section 4920, such as sleeve) and also coupled the plate 400 to the power end 102 in a spaced relationship (e.g., with the spacing defined by enlarged section 4910, such as sleeve). Openings 410 extend through the plate 400, from a front surface 404 of a main body of the plate 400 to a back surface 402 of the main body of the plate 400 (i.e., openings 410 are through holes) and are generally sized to receive the elongate main body 4901 of the elongate couplers 490. However, in at least some embodiments, openings 410 need not be constantly sized and can vary with respect to other openings 410, e.g., to match varied diameters of the elongate main body 4901 of the elongate couplers 490 (e.g., varied based on known load distribution).

Still referring to FIG. 7, but now in combination with FIG. 6, openings 410 define an amount of space "X1" that will be provided between elongate couplers 490 (an example of which is generally depicted with a dashed line in FIG. 7). In at least some embodiments, this space X1 is larger than an outer dimension of a removable stuffing box 330 so that elongate couplers 490 do not interfere with installation of the removable stuffing box. Additionally, the space X1 may generally surround each opening of a second set of openings 420, each of which configured to receive a pony rod 185 and/or a reciprocating element 202 (e.g., depending on the position of a stroke and/or the specific lengths/arrangements of these components). Thus, elongate couplers 490 may be positioned to create a structurally sound cage around the second set of openings 420. As mentioned, openings 420 may also include threaded inner walls 421 so that a fluid end component 334 may be threadably coupled to openings 420. Then, the fluid end component 334, which may be annular, may receive a pony rod 185 and/or a reciprocating element 202.

The plate 400 also extends from a first end 406 to a second end 408. In the depicted embodiment, the first end 406 is generally aligned with a first side 365 (see FIGS. 3A and 3B) of the power end 102 and the second end 408 is generally aligned with a second side 366 (see FIGS. 3A and 3B) of the power end 102. That is, in the depicted embodiment, the plate 400 laterally spans the power end 102. However, in other embodiments, the plate 400 can span any portion of the power end 102 (and/or the fluid end 302) and/or extend beyond the lateral ends of the power end 102. Additionally or alternatively, the plate 400 can be modular and can include sub-plates that collectively span any portion of the power end 102 (and/or the fluid end 302) and/or collectively extend beyond the lateral ends of the power end 102 (and/or the fluid end 302). Meanwhile, the plate 400 may extend longitudinally so that the plate 400 spans any portion of the power end 102 (and/or the fluid end 302) and/or extends beyond the longitudinal ends (e.g., top and bottom) of the power end 102 (and/or the fluid end 302).

Now turning to FIGS. 6 and 8-10, in the depicted embodiment, the elongate couplers 490 couple the plate 400 to the fluid end 302 by extending entirely through the fluid end casing 306, from the front side 311 of the fluid end casing 306 to the back side 312 of the fluid end casing 306. To realize this, the fluid end casing 306 includes through holes 313 disposed laterally between sets of casing bores (e.g., between sets of intersecting bores 322, 324, 326, and 328). This lateral positioning is best understood by juxtaposing the sectional view of FIG. 5, which includes casing bores segments, with the sectional view of FIG. 9, which does not include casing bore segments. Instead, the lateral sections of casing 306 that include through holes 313 have a lateral conduit 2081 that interconnects sets of bores that extend within casing 206 (e.g., to interconnect sets of intersecting bores 322, 324, 326, and 328). Conduit 2081 may connect to and/or form a portion of a channel 108 (see, e.g., FIG. 1) through which fluid discharges from the fluid end 302.

When the couplers 490 extend through holes 313, nuts 491 can be installed on distal ends 4902 of the elongate main body 4901 of the elongate couplers 490 to secure the fluid end casing 306 against the elongate couplers 490. Alternatively, the distal end 4902 may be secured against the back side 312 in any desirable manner. In any case, when the elongate main bodies 4901 of elongate couplers 490 extend through holes 313, the connection between the plate 400 and the fluid end 302 can be formed and tightened (e.g., via nuts 491) on the back side 312 of the fluid end casing 306, which is often less obstructed and easier to access than the front side 311 of the fluid end casing 306. That is, when the elongate couplers 490 extend through holes 313, the fluid end 302 may be connected to a power end 102 without tightening connections disposed on the front side 311 of fluid end casing 306. This may make installation easier and quicker as compared to arrangements that require torquing in tight locations on the front side 311 of casing 306.

Figure 8:
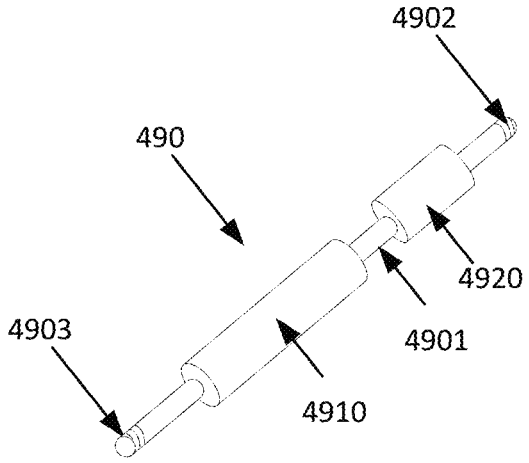
FIG. 8 is a side perspective view of a coupler included in the reciprocating pump illustrated in FIGS. 3A, 3B, 4, and 5.

At the opposite end of the elongate main body 4901, the first or proximal end 4903 of the elongate main body 4901 may engage the mount plate 180 and/or the nose plate 172 of a power end 102 (or otherwise directly engage the power end 102). As a specific example, elongate couplers 490 may be tie rods with threaded ends 4903 and 4902 (these threads are illustrated in FIG. 8, but are only an example). Then, the first threaded end 4903 may thread into an opening in mount plate 180 while the second threaded end 4902 is threadably engaged with a nut 491 on the back side 312 of the fluid end casing 306. Furthermore, as has been explained repeatedly herein, the elongate couplers 490 may each include enlarged sections 4910 and 4920 to space the plate 400 from the power end 102 and the fluid end 302. Enlarged sections 4910 and 4920 need not be formed as separate components from the elongate main body 4901 and could comprise any number of geometries, sizes, etc. that might position the plate 400 in a spaced relationship with respect to the power end 102 and/or the fluid end 302. As one example, the enlarged sections 4910 and 4920 can comprise sleeves that are movable along the main bodies 4901.

Now turning specifically to FIG. 10 in combination with FIG. 5, as mentioned, reducing the load experienced by the removable stuffing box 330 may allow the removable stuffing box 330 to be coupled to the fluid end casing 306 with fewer and/or weaker couplers 331. Thus, in FIG. 10, the removable stuffing box 330 is shown coupled to the front side 311 of the fluid end casing 306 with twelve couplers 331. More specifically, in this particular embodiment, the removable stuffing box 330 includes a first portion 3310 and a second portion 3320. The first portion 3310 extends from the front end 3301 of the removable stuffing box 330 and the second portion 3320 extends from the back end 3302 of the removable stuffing box 330, with the first portion 3310 and the second portion 3320 meeting at a step or shoulder. The second portion 3320 has a reduced diameter as compared to the first portion 3310 and, thus, can be inserted into the reciprocation bore 328. Meanwhile, the couplers 331 extend through the first portion 3310 and into the front side 311 of the fluid end casing 306 to couple the removable stuffing box 330 to the fluid end casing 306. However, in other embodiments, a removable stuffing box might include any desirable geometry and might be coupled to the fluid end casing 306 in any desirable manner (e.g., via threading, a retaining ring, etc.) to form a portion of reciprocation bore 328. Moreover, as mentioned, in at least some embodiments, a removable stuffing box may comprise a fluid end component that is secured to the casing 306 by plate 400.

Figure 11:
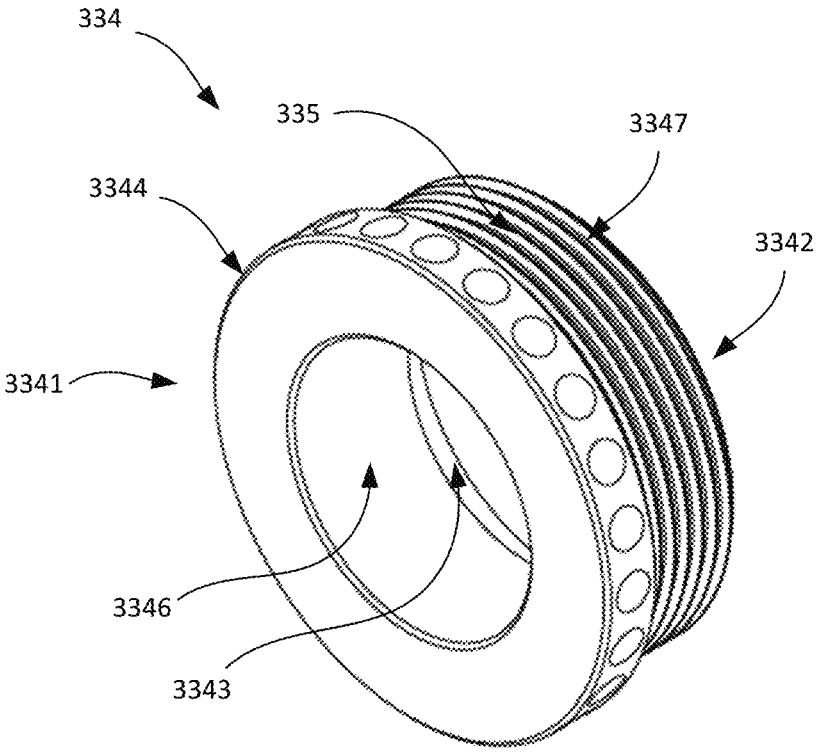
FIG. 11 is a front perspective view of the fluid end component that is coupled to the cradle plate in the reciprocating pump illustrated in FIGS. 3A, 3B, 4, and 5.
Figure 12:
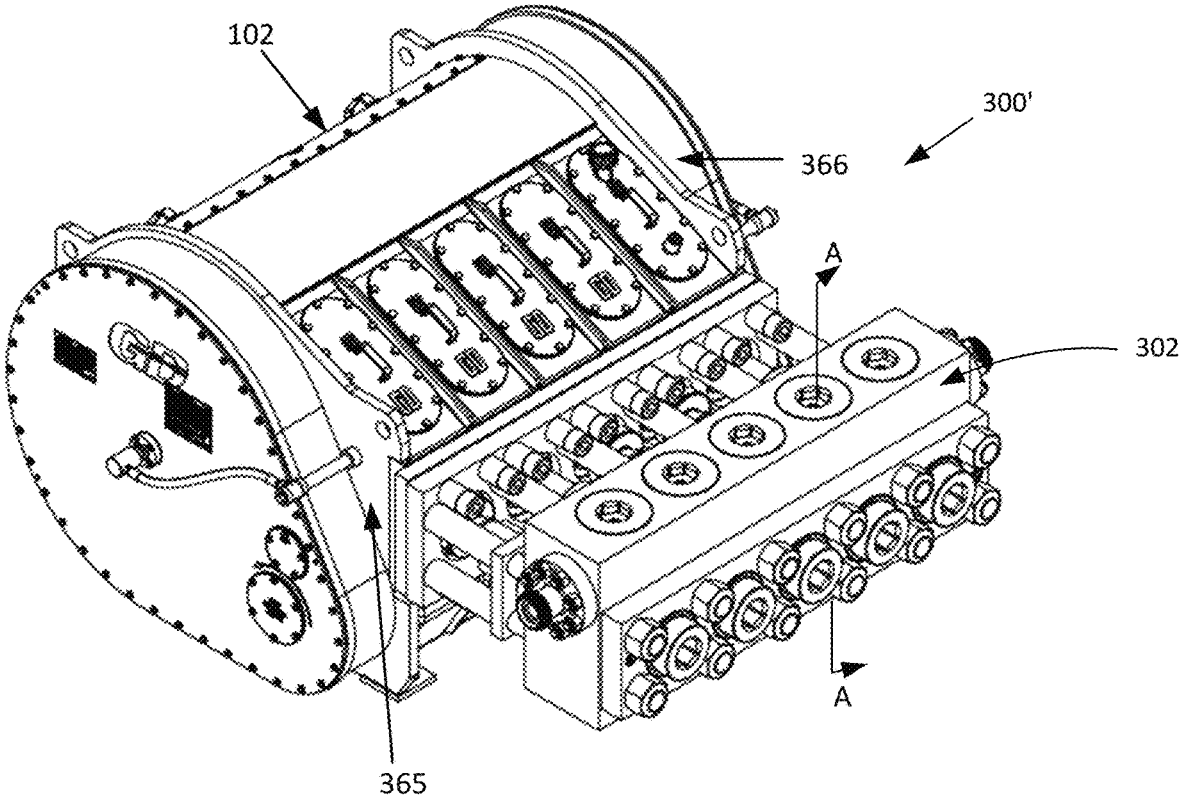
FIG. 12 is a front perspective view of a reciprocating pump including a cradle plate, according to another example embodiment of the present application.
Figure 13:
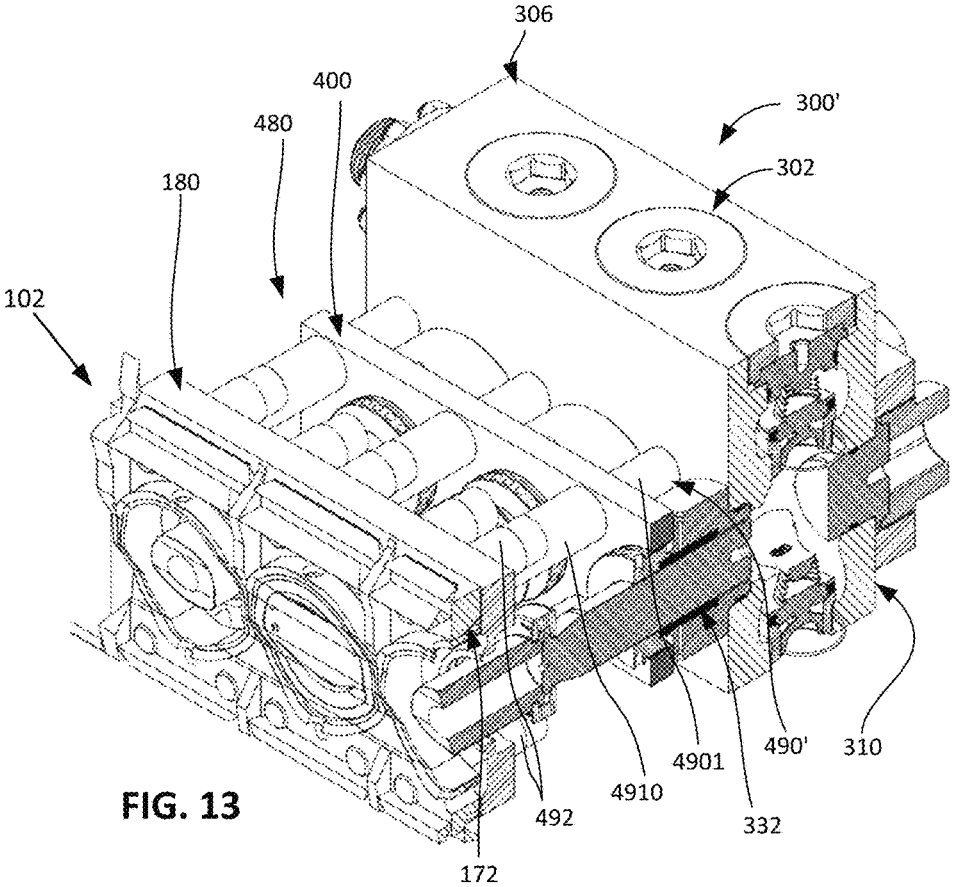
FIGS. 13 and 14 are perspective and side cross-sectional views, respectively, of the reciprocating pump illustrated in FIG. 12 taken along line "A-A" of FIG. 12.
Figure 14:
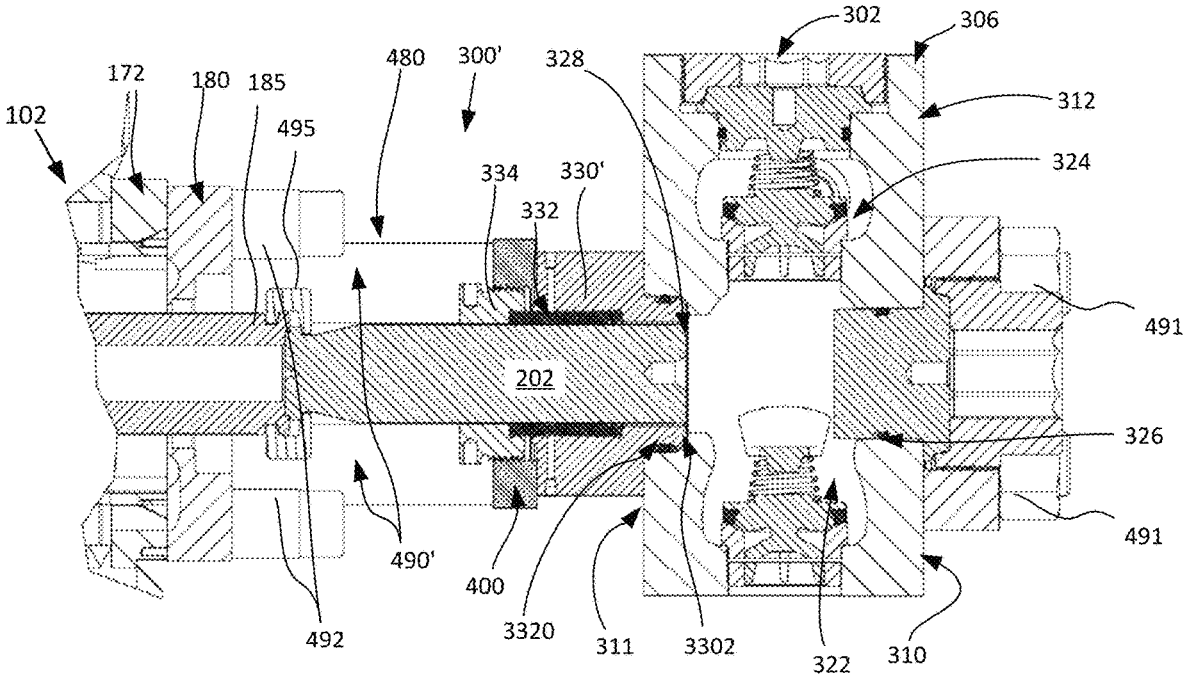
Figure 15:
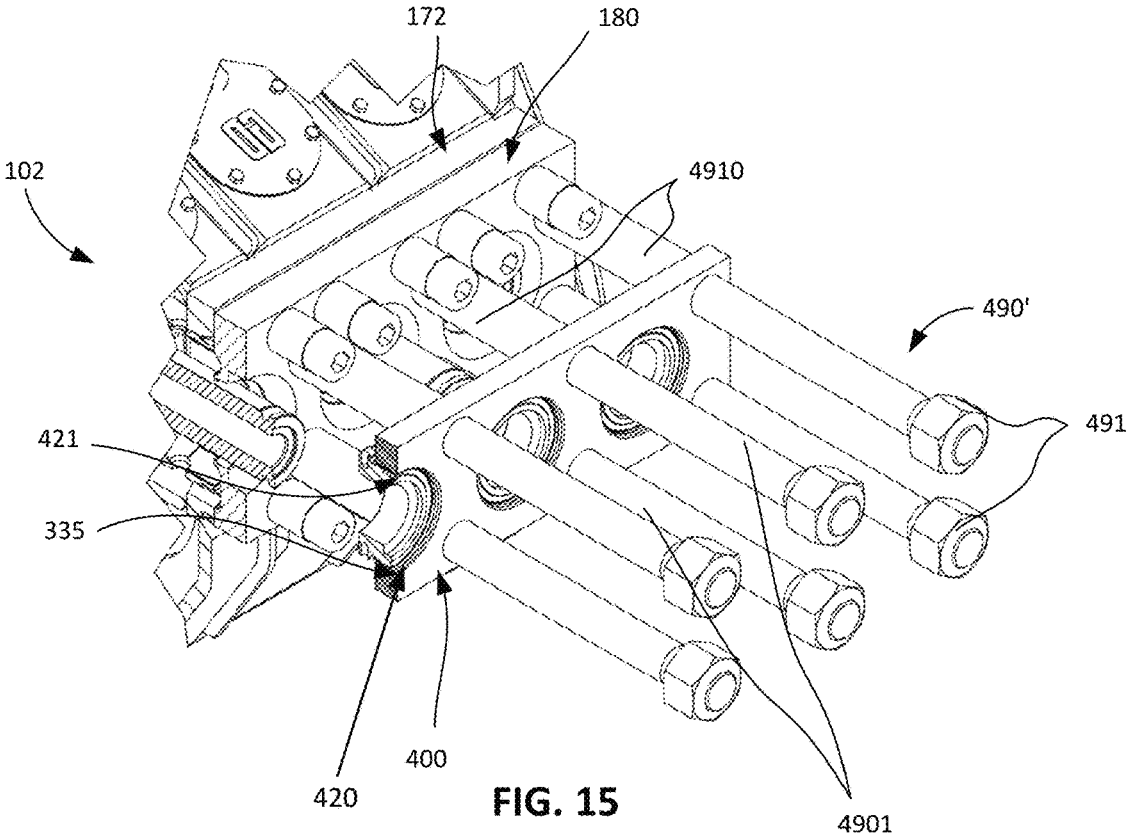
FIG. 15 is a perspective cross-sectional view of the reciprocating pump illustrated in FIG. 12 taken along line "A-A" of FIG. 12, with the fluid end of the reciprocating pump removed.
Figure 16:
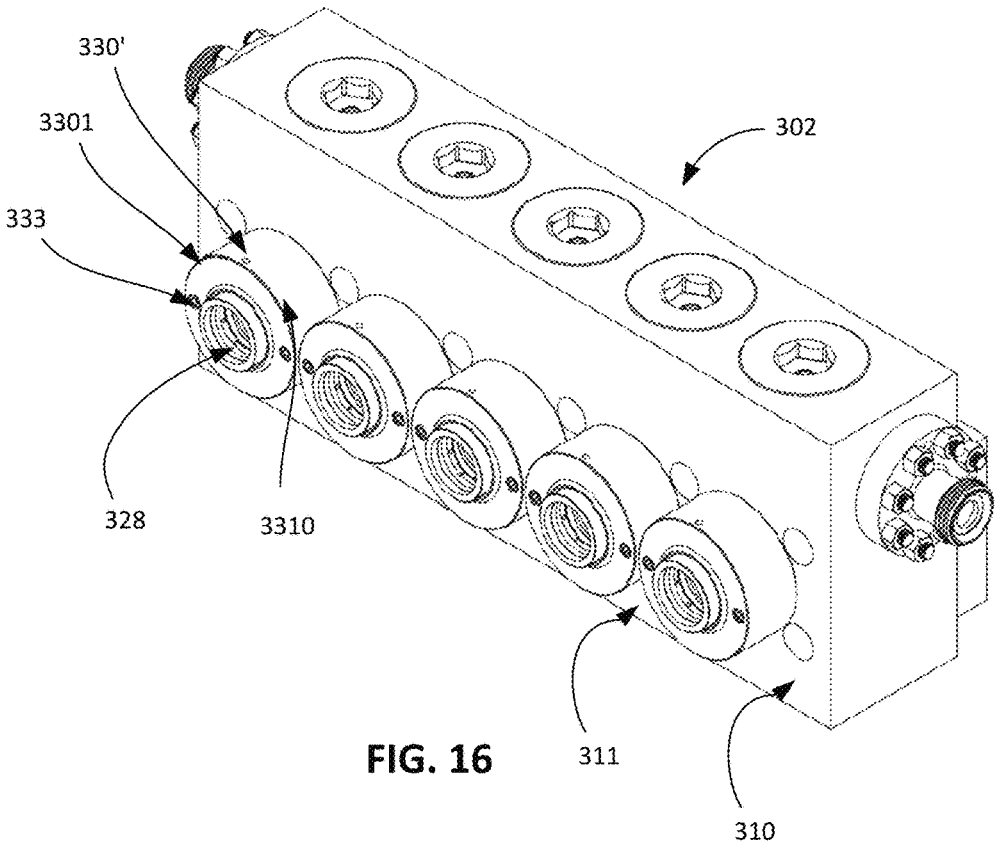
FIG. 16 is a front perspective view of a fluid end component positioned against the fluid end of the reciprocating pump illustrated in FIGS. 12-14.

That said, in the particular embodiment of FIGS. 3A, 3B, and 4-11, the fluid end component secured to the fluid end 302 with plate 400 comprises retaining nut. FIG. 11 depicts a perspective view of this fluid end component 334. As can be seen, the fluid end component 334 extends from a first or outer end 3341 to a second or inner end 3342. The inner end 3342 includes a recess 3343 that is configured to receive a portion of packing seals 332 while the outer end 3341 includes a flange 3344 that allows a user to grip and torque the fluid end component 334 into place (e.g., within plate 400). Between the outer end 3341 and the inner end 3342, the fluid end component 334 is annular and includes a smooth inner surface 3346 and an outer surface 3347 with threads 335. As mentioned, threads 335 can engage threaded inner walls 421 of openings 420 included in the plate 400. The inner surface 3346 is smooth so that a plunger or piston can reciprocate therein. However, in other embodiments, the fluid end component 334 need not be annular, need not include threads 335, and may include any desirable features or geometries. For example, the fluid end component 334 can be a removable stuffing box.

Now turning to FIGS. 12-16, these Figures depict various views of at least a portion of another embodiment of a reciprocating pump 300' with a plate 400 that couples a fluid end component to a fluid end casing 306. This embodiment is substantially similar to the embodiment described above in connection with FIGS. 3A, 3B, and 4-11. Thus, for brevity, like or similar parts are not described again and any description of parts or features of FIGS. 3A, 3B, and 4-11 included herein should be understood to apply to like or similar parts of FIGS. 12-16. For example, plate 400 is still disposed between the power end 102 and the fluid end 302 and generally configured to position a fluid end component 334 against a seal or seal assembly (e.g., packing seals 332) of the fluid end 302. However, now, elongate couplers 490' include a single enlarged section 4910 positioned between the power end 102 and the plate 400 and use a removable stuffing box 330' to space the plate 400 from the fluid end 302. Thus, as mentioned, for the purposes of this application, a stuffing box may be considered a component which the plate 400 can position against a casing 306 of fluid end 302 and/or a seal of the fluid end 302. Consequently, removable stuffing box 330' may also be referred to as fluid end component 330'.

Since the fluid end component 330' spaces the plate 400 from the fluid end casing 306, the plate 400 also serves to secure the fluid end component 330' in place against the fluid end casing 306. That is, the plate 400 sandwiches the fluid end component 330' against the fluid end casing 306. Or, from another perspective, the fluid end component 330' positions the plate 400 in the cradle 480. Either way, since the plate 400 fully secures the fluid end component 330' in place, the fluid end component 330' does not require couplers (e.g., couplers 331, as used in FIG. 10), such as bolts, to be installed through the fluid end component 330' (and into fluid end casing 306) with a specific installation torque. Instead, the fluid end component 330' can be secured against the fluid end casing 306 by plate 400, without assistance of another fastener or coupling technique.

Then, the entire load experienced by the fluid end component 330' (as well as any load experienced by fluid end component 334) transfers to the elongate couplers 490' via the plate 400 (e.g., as opposed to be transmitted to couplers 331, e.g., bolts, that connect the removable stuffing box to the fluid end). However, simply to make sure the fluid end component 330' does not move or shift during assembly of reciprocating pump 300', the removable stuffing box 330 may be configured, in at least some embodiments, to receive two positioners 333 that hold the fluid end component 330' in place during assembly. The two positioners 333 are not sufficient to retain the fluid end component 330' during a pumping operation nor are they sufficient to support a load experienced by the fluid end component 330'. Instead, the positioners 333 are merely used to case assembly and disassembly procedures.

Alternatively, if desired, the couplers 331 (see FIG. 10) installed through the fluid end component 330' need not be completely eliminated and, instead, can be reduced. Either way, the absence or minimization of couplers 331 will drastically improve the serviceability of the fluid end component 330' because the installation or removal time will be either eliminated or nearly eliminated. For example, when the fluid end component 330' only includes one or more positioners 333, the fluid end component 330' can be removed from the fluid end casing 306 without removing any torqued fasteners/couplers. Thus, the fluid end component 330' can be removed or installed nearly immediately and will not be the driving cause of downtime.

Figure 17:
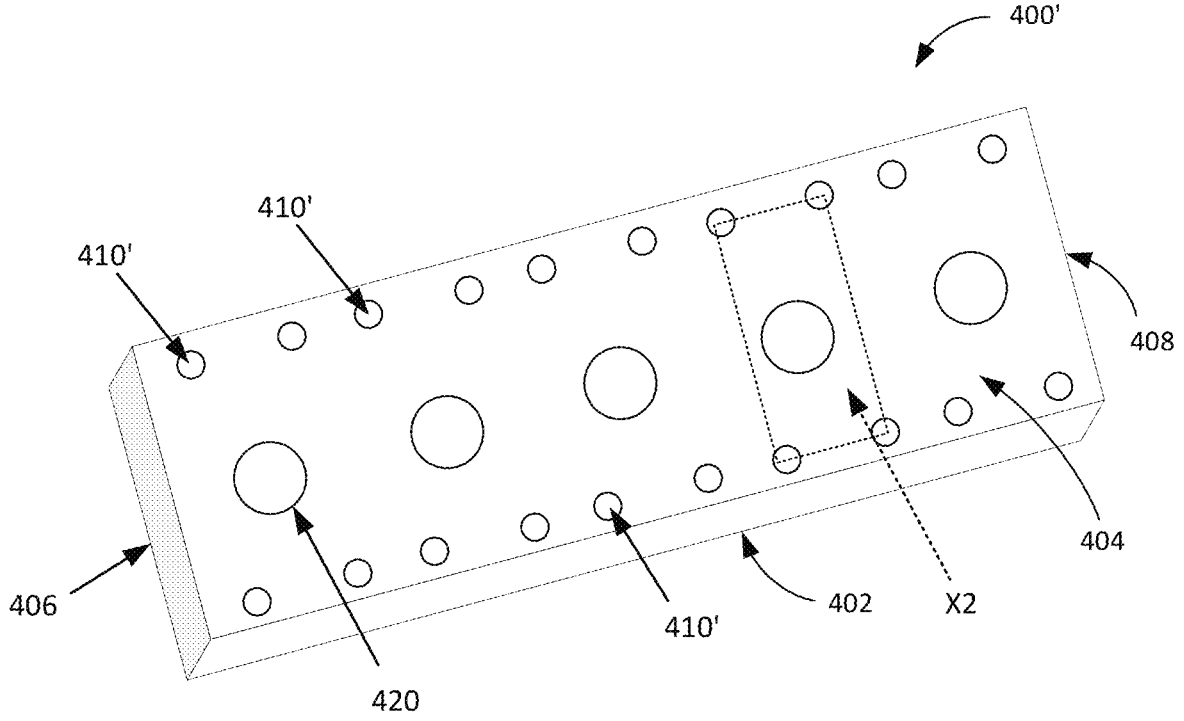
FIG. 17 is a front perspective view of a cradle plate according to another example embodiment of the present application.

Now turning to FIG. 17, this Figure depicts a perspective view of another embodiment of a plate 400' that may be positioned in a cradle 480 to securely position a fluid end component against a seal and/or the casing. Plate 400' is substantially similar to plate 400 and, thus, any description of parts or features of plate 400 should be understood to apply to plate 400'. For example, plate 400' has a main body that extends from a front surface 404 to a back surface 402. Similarly, plate 400' extends from a first end 406 to a second end 408 and these ends may align with, extend past, and/or terminate within the lateral bounds of a power end 102. However, now, the first set of openings 410' are spaced further apart than the first set of openings 410. Thus, the first set of openings 410' define a space X2 around a second opening 420 that is larger than space X1, at least in a height dimension. This expanded spacing may allow the first set of openings 410' to receive elongate couplers 490 positioned in a different arrangement than the arrangement shown in the preceding embodiments and is depicted as an example of how the plate presented herein may be compatible across a wide variety of reciprocating pump arrangements.

Figure 18:
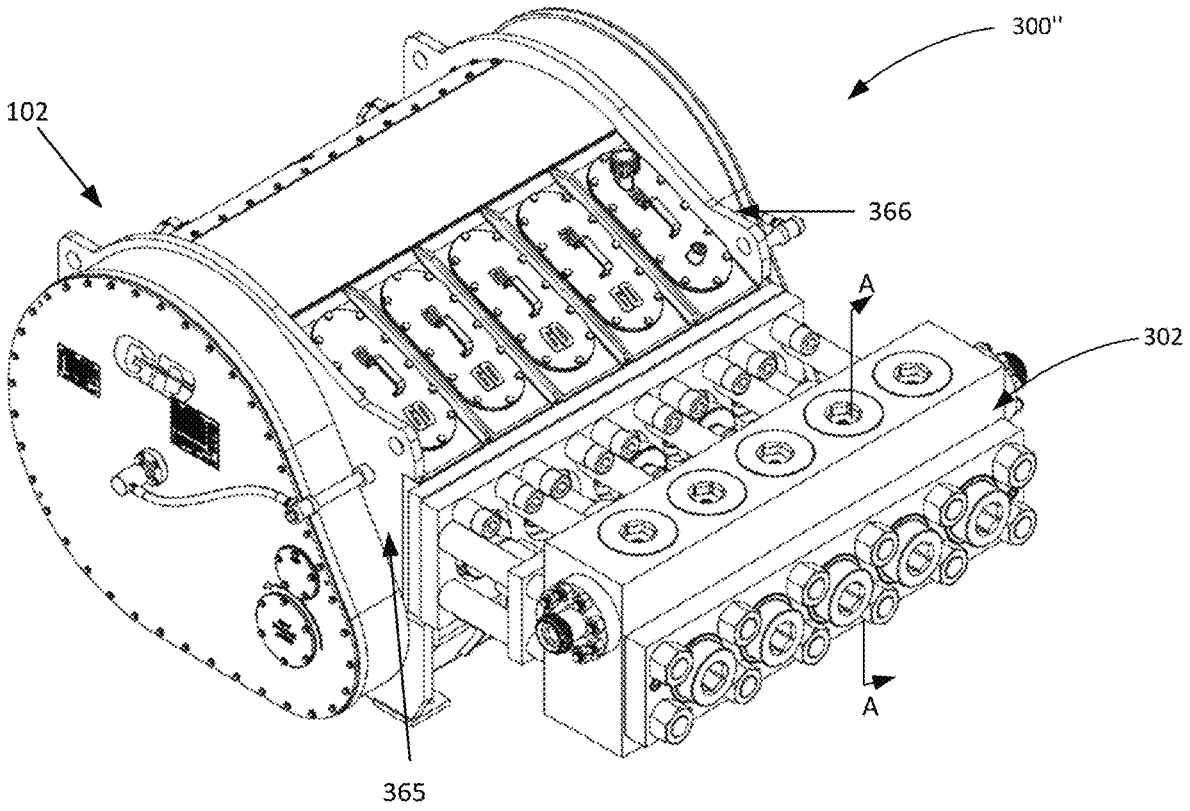
FIG. 18 is a front perspective view of a reciprocating pump including a cradle plate, according to yet another example embodiment of the present application.
Figure 19:
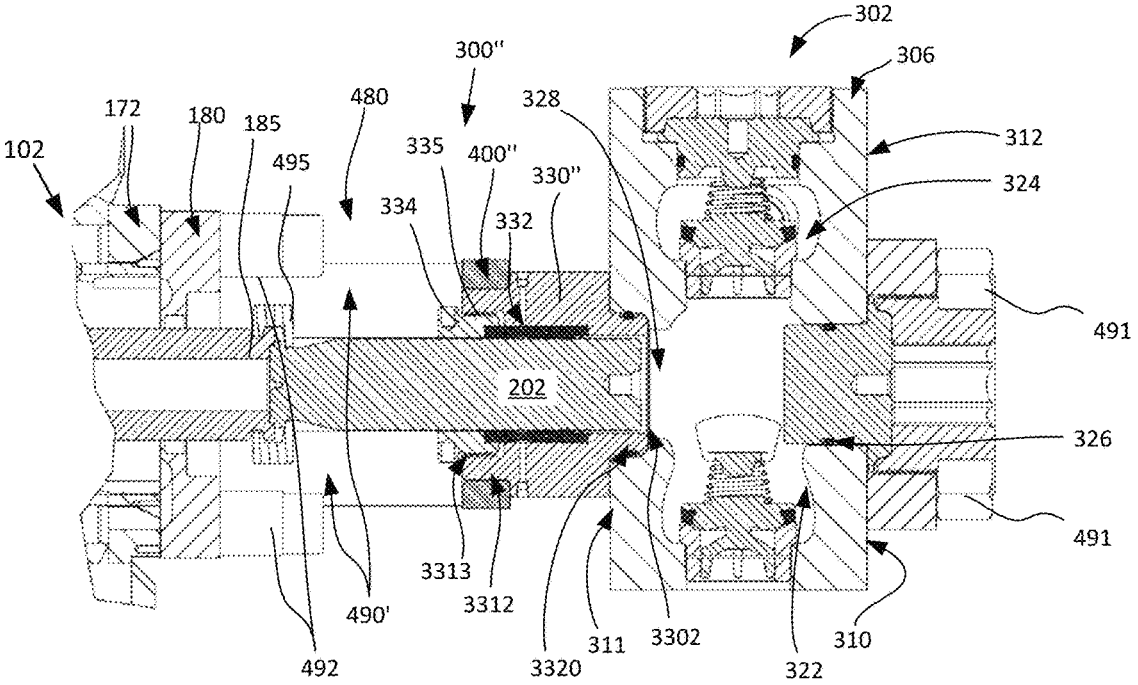
FIG. 19 is a side cross-sectional view of the reciprocating pump illustrated in FIG. 18 taken along line "A-A" of FIG. 18.
Figure 20:
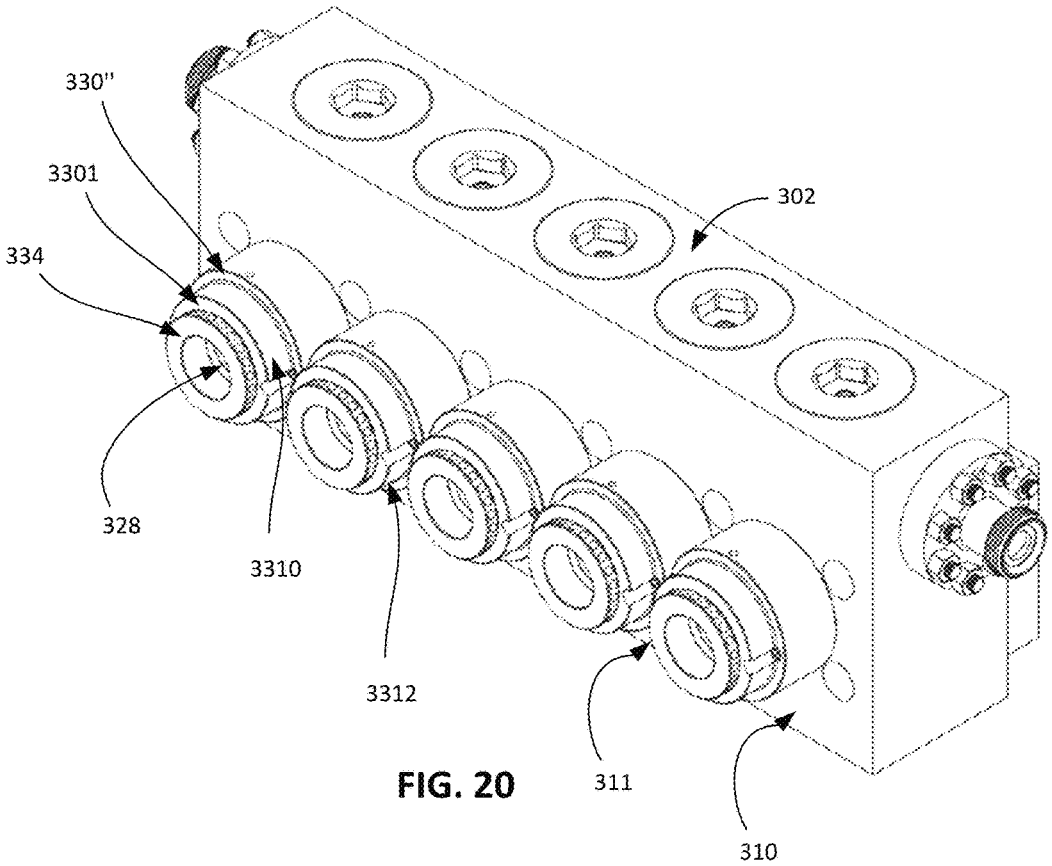
FIG. 20 is a front perspective view of a fluid end component positioned against the fluid end of the reciprocating pump illustrated in FIGS. 18 and 19.
Figure 21:
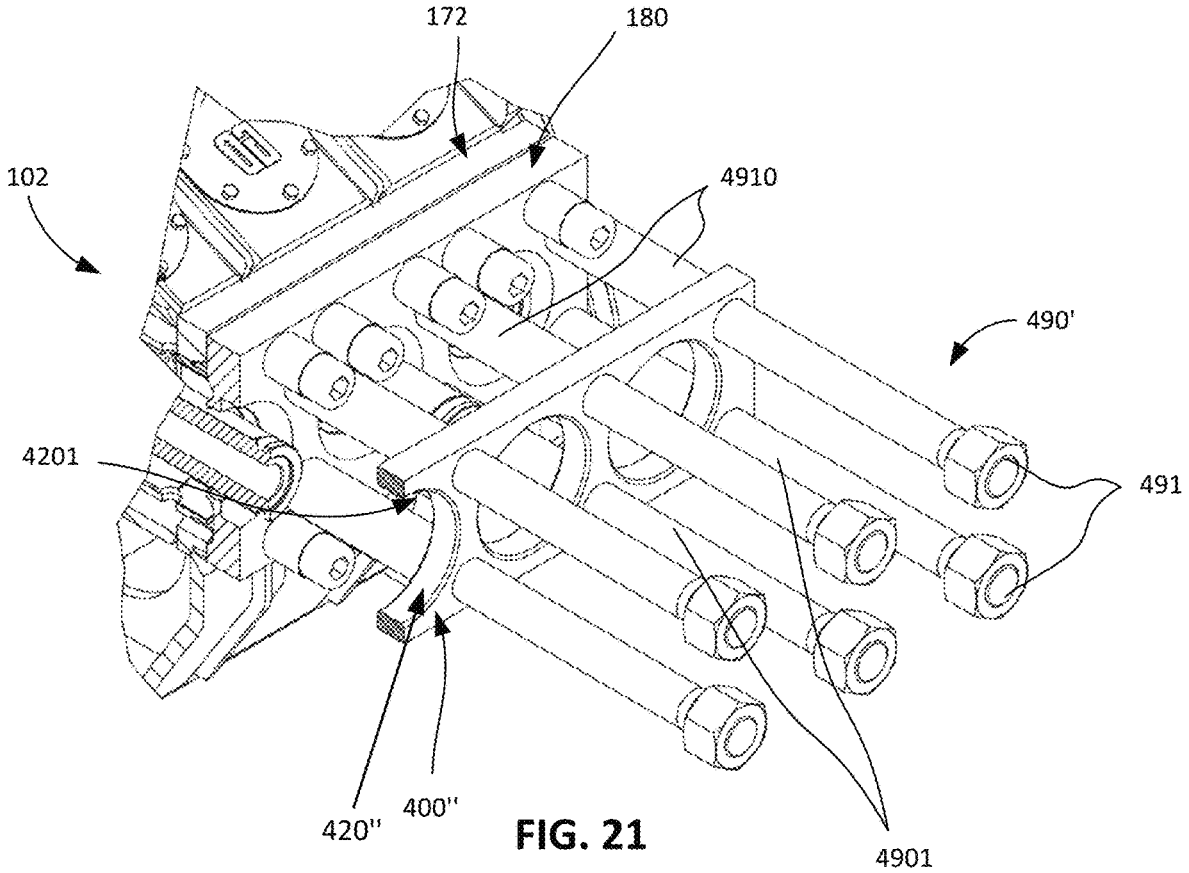
FIG. 21 is a perspective cross-sectional view of the reciprocating pump illustrated in FIG. 18 taken along line "A-A" of FIG. 18, with the fluid end of the reciprocating pump removed.

Next, FIGS. 18-20 depict various views of at least a portion of another embodiment of a reciprocating pump 300" with a plate 400" that couples a fluid end component to a fluid end casing 306. This embodiment is substantially similar to the embodiment described above in connection with FIGS. 12-16. Thus, for brevity, like or similar parts are not described again and any description of parts or features of FIGS. 12-16 included herein should be understood to apply to like or similar parts of FIGS. 18-20. For example, plate 400" is still disposed between the power end 102 and the fluid end 302 and generally configured to position a fluid end component 330" (e.g., in the form of a removable stuffing box) against the fluid end casing 306. Additionally, like FIGS. 12-16, elongate couplers 490' include a single enlarged section 4910 positioned between the power end 102 and the plate 400 and use a removable stuffing box 330" to space the plate 400 from the fluid end 302. However, now gland nut 334 may be secured directly to the fluid end component 330" instead of the plate 400".

More specifically, in the depicted embodiment, the removable stuffing box 330" includes a flange or receptacle section 3312 that extends distally from the first portion 3310 of the removable stuffing box 330" (e.g., away from the fluid end casing 306 and/or away from the back end 3302 of the removable stuffing box 330") and the receptacle section 3312 includes a threaded inner surface 3313. The threaded inner surface 3313 is configured to mate with threads 335 of the fluid end component 334 to removably coupled the fluid end component 334 to the removable stuffing box 330". However, in other embodiment, a removably connection could be formed in any manner now known or developed hereafter.

Since the fluid end component 334 does not threadably engage plate 400", the openings 420" of plate 400" need not include threaded inner walls 421 (like in FIGS. 12-16). Instead, the openings 420" of plate 400" may have an interior surface 4201 that is smooth and/or non-threaded. Nevertheless, when the fluid end component 334 is installed in the removable stuffing box 330", a load experienced by the removable stuffing box 330" and/or fluid end component 334 may still transfer to the elongate couplers 490', away from these components and/or the fluid end casing 306. This is because the removable stuffing box 330" and/or fluid end component 334 are tightly coupled against the plate 400', which is supported by 490". In particular, the removable stuffing box 330" may be sandwiched between the plate 400" and the casing 306. Additionally or alternatively, when the fluid end component 334 is installed in the removable stuffing box 330" (e.g., by mating threads 335 with threads 3313), the fluid end component 334 can tighten against a back surface of plate 400", essentially sandwiching the 400" between the 334 and the removable stuffing box 330".

Figure 22:
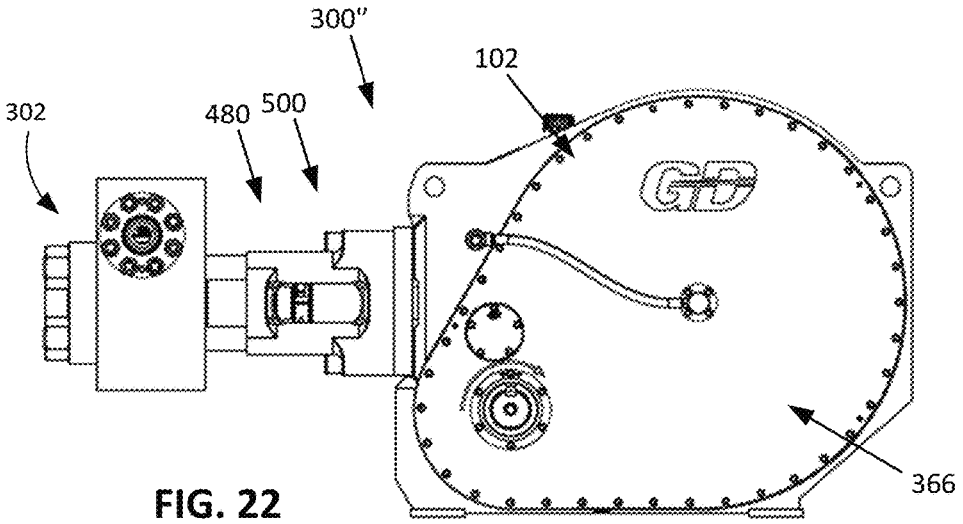
FIG. 22 is a side view of a reciprocating pump including a cradle plate, according to still another example embodiment of the present application.
Figure 23:
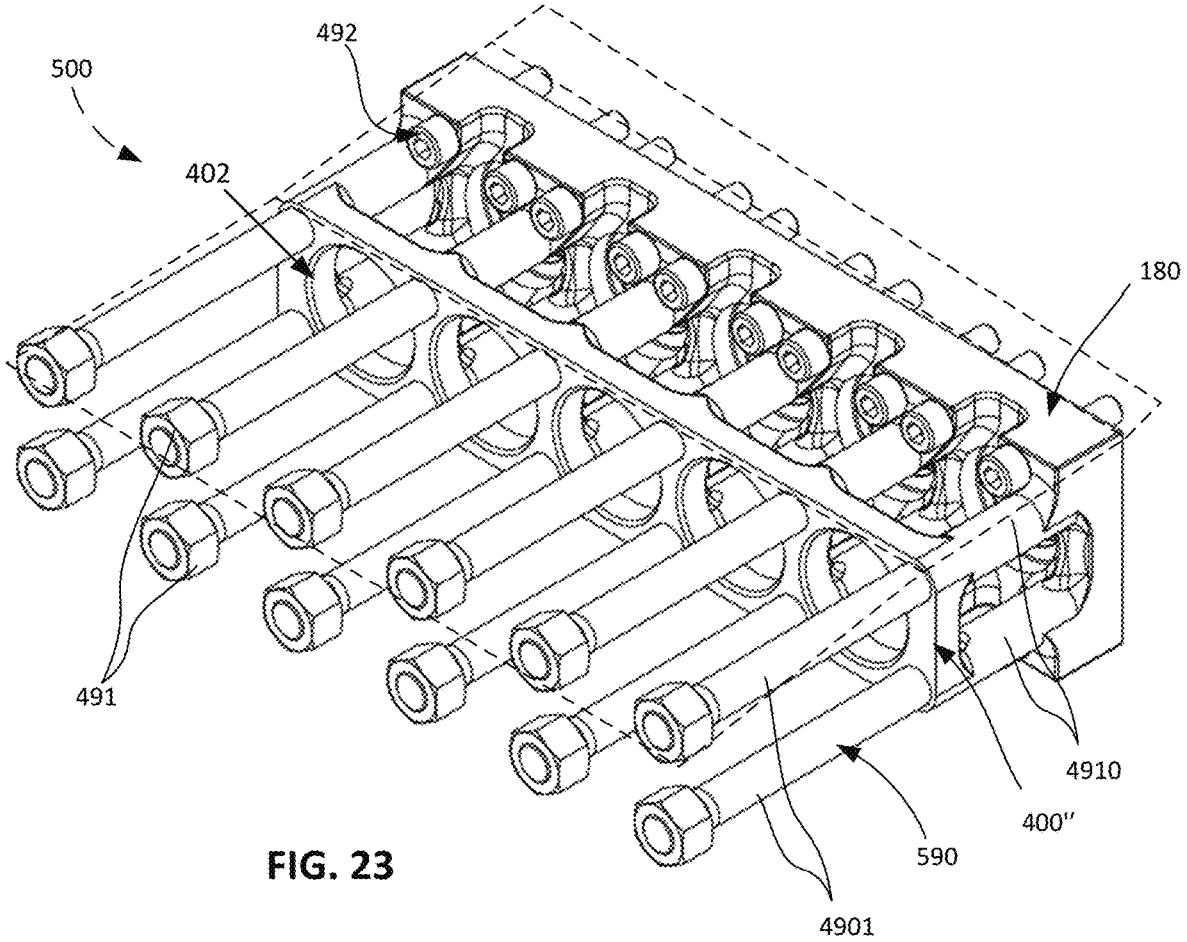
FIG. 23 is a perspective cross-sectional, schematic view of the reciprocating pump illustrated in FIG. 22, with the fluid end of the reciprocating pump removed.

Now turning to FIGS. 22 and 23, these Figures depict a general concept that may be applicable to any embodiment of the present application, including, but not limited to, the embodiments depicted in the Figures. For simplicity, this concept is primarily depicted as an alternative version of pump 300" of FIGS. 18-20, but this should not be understood to be limiting in any manner. That is, while FIGS. 22 and 23 depict another embodiment of reciprocating pump 300" (e.g., of FIGS. 18-20), this should not be understood to be limiting in any manner. Moreover, since this embodiment is substantially similar to previously described embodiments, like or similar parts are not described again. Instead, any description of parts or features of included herein should be understood to apply to like or similar parts of FIGS. 22 and 23.

That all said, in FIGS. 22-23, the plate 400 is formed unitarily or integrally with other parts of the pump 300" generally disposed in cradle 480, as part of a spacer assembly 500 (generally denoted by dashed boundaries). More specifically, in the depicted embodiment, the plate 400, the enlarged sections 4910 and the mount plate 180 are formed as a single piece or part to create the spacer assembly 500 (the central dashed box). For example, the plate 400, the enlarged sections 4910 and the mount plate 180 may be cast or forged as a single part (and potentially machined) to form the spacer assembly 500. Meanwhile, the elongate main bodies 4901 of elongate couplers 490 and the couplers 492 are each be formed separately from the spacer assembly 500. Then, during installation, the elongate main bodies 4901 and the couplers 492 may each be inserted into and extend through at least a portion the spacer assembly 500 to couple the spacer assembly 500 to a fluid end 302 and a power end 102.

However, in other embodiments, one or both of the elongate main bodies 4901 and the couplers 492 could be formed as part of the spacer assembly 500. Thus, in FIG. 23, additional dashed boundaries are shown around elongate main bodies 4901 and couplers 492, indicating potential inclusion of these components in a unitary (e.g., single piece) spacer assembly 500. For example, elongate main body 4901 might be formed integrally formed with the plate 400, the enlarged sections 4910 and the mount plate 180 so that the entire spacer assembly 500 can be attached to a fluid end 302 with a single operation: attaching nuts 491 to distal ends of the elongate main bodies 4901 when the distal ends are protruding through a fluid end casing 306.

While the invention has been illustrated and described in detail and with reference to specific embodiments thereof, it is nevertheless not intended to be limited to the details shown, since it will be apparent that various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

Similarly, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer" and the like as may be used herein, merely describe points of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Finally, when used herein, the term "comprises" and its derivations (such as "comprising", etc.) should not be understood in an excluding sense, that is, these terms should not be interpreted as excluding the possibility that what is described and defined may include further elements, steps, etc. Meanwhile, when used herein, the term "approximately" and terms of its family (such as "approximate," etc.) should be understood as indicating values very near to those which accompany the aforementioned term. That is to say, a deviation within reasonable limits from an exact value should be accepted, because a skilled person in the art will understand that such a deviation from the values indicated is inevitable due to measurement inaccuracies, etc. The same applies to the terms "about" and "around" and "substantially."

What is claimed is:

1. A reciprocating pump, comprising:

a power end configured to generate pumping power;

a fluid end configured to deliver a fluid from an inlet bore to an outlet bore as the power end generates the pumping power, wherein the fluid end comprises a fluid end casing and a removable stuffing box secured to the fluid end casing;

a cradle plate positioned between the power end and the fluid end and offset from the fluid end casing; and a coupler that couples the power end and the fluid end to one another, wherein the coupler extends through an opening of the cradle plate and positions the cradle plate to secure a retaining nut against a packing seal disposed in the removable stuffing box.

2. The reciprocating pump of claim 1, wherein the coupler extends through an entirety of the fluid end casing.

3. The reciprocating pump of claim 1, wherein the coupler comprises a tie rod with a sleeve that offsets the cradle plate from the fluid end casing.

4. The reciprocating pump of claim 3, wherein the tie rod comprises an additional sleeve that offsets the cradle plate from the power end.

5. The reciprocating pump of claim 1, wherein the power end comprises a mount plate, and an end of the coupler is coupled to the mount plate.

6. The reciprocating pump of claim 5, wherein an additional end, opposite the end, of the coupler is coupled to the fluid end.

7. The reciprocating pump of claim 1, wherein the cradle plate comprises a second opening configured to receive the retaining nut.

8. A reciprocating pump, comprising:

a power end configured to generate pumping power;

a fluid end configured to deliver a fluid from an inlet bore to an outlet bore as the power end generates the pumping power, wherein the fluid end comprises a fluid end casing and a removable stuffing box secured to the fluid end casing;

a coupler that couples the power end and the fluid end to one another;

a cradle plate positioned between the power end and the fluid end, wherein the cradle plate comprises an opening configured to receive the coupler to offset the cradle plate from the fluid end casing; and a retaining nut secured against a packing seal disposed in the removable stuffing box.

9. The reciprocating pump of claim 8, wherein the fluid end casing comprises a hole, the coupler extends through the hole such that an end of the coupler is external to the fluid end, and the reciprocating pump comprises a nut coupled to the end of the coupler to secure the coupler to the fluid end.

10. The reciprocating pump of claim 8, wherein the removable stuffing box extends between the cradle plate and the fluid end casing.

11. The reciprocating pump of claim 8, wherein the packing seal extends into an additional opening of the cradle plate, and the retaining nut extends into the additional opening to secure against the packing seal.

12. The reciprocating pump of claim 11, wherein the retaining nut is positioned external to the removable stuffing box.

13. The reciprocating pump of claim 8, wherein the retaining nut extends around a portion of the packing seal to secure against the packing seal.

14. A reciprocating pump, comprising:

a fluid end configured to deliver a fluid from an inlet bore to an outlet bore, wherein the fluid end comprises a removable stuffing box and a fluid end casing;

a retaining nut;

a cradle plate that secures the retaining nut against a packing seal disposed in the removable stuffing box; and a coupler that couples the cradle plate to the fluid end, wherein the coupler extends through the cradle plate and blocks the cradle plate from contacting the fluid end casing.

15. The reciprocating pump of claim 14, wherein the coupler comprises a tie rod with a plurality of sleeves.

16. The reciprocating pump of claim 15, wherein a sleeve of the plurality of sleeves blocks the cradle plate from contacting the fluid end casing.

17. The reciprocating pump of claim 14, wherein the removable stuffing box is positioned at a first side of the fluid end casing, and the coupler extends from the first side of the fluid end casing to a second side, opposite the first side, of the fluid end casing.

18. The reciprocating pump of claim 14, wherein the retaining nut extends into an opening of the cradle plate to secure against the packing seal disposed in the removable stuffing box.

19. The reciprocating pump of claim 14, wherein the retaining nut is offset from the removable stuffing box.

20. The reciprocating pump of claim 14, wherein the coupler separates the cradle plate from the removable stuffing box.

* * * * *